US010981415B2

(12) United States Patent
Spiro et al.

(10) Patent No.: US 10,981,415 B2
(45) Date of Patent: Apr. 20, 2021

(54) SYSTEM FOR MOUNTING A COVERING UPON A FRAME

(71) Applicant: Tracer Imaging LLC, Ossining, NY (US)

(72) Inventors: Steven M. Spiro, Chappaqua, NY (US); Stephen S. Daniell, Northampton, MA (US); Theodore Petroulas, New York, NY (US); Paul Dowd, Scarsdale, NY (US); Ryan Kelly, Yorktown Heights, NY (US); Bennet Otto Poepping, Tuckahoe, NY (US); Kevin Skeuse, New York, NY (US); Erol Searfoss, Philadelphia, PA (US); Jack Fernandez, Delray Beach, FL (US)

(73) Assignee: TRACER IMAGING LLC, Ossining, NY (US)

( * ) Notice: Subject to any disclaimer, the term of this patent is extended or adjusted under 35 U.S.C. 154(b) by 7 days.

(21) Appl. No.: 16/219,374

(22) Filed: Dec. 13, 2018

(65) Prior Publication Data

US 2019/0217658 A1 Jul. 18, 2019

Related U.S. Application Data

(63) Continuation of application No. 15/265,417, filed on Sep. 14, 2016, now Pat. No. 10,189,299.
(Continued)

(51) Int. Cl.
*B44D 3/18* (2006.01)
*D06C 3/08* (2006.01)

(52) U.S. Cl.
CPC ..... *B44D 3/185* (2013.01); *B44D 3/18* (2013.01); *D06C 3/08* (2013.01)

(58) Field of Classification Search
CPC . B44D 3/185; B44D 3/18; D06C 3/00; D06C 3/08; E04C 2/00; E04C 2/38;
(Continued)

(56) References Cited

U.S. PATENT DOCUMENTS 1,463,150 A 7/1923 Carisen
2,155,729 A 4/1939 Mainieri
(Continued)

FOREIGN PATENT DOCUMENTS

DE 199 00 831 5/2000
EP 1149550 A2 * 10/2001
(Continued)

OTHER PUBLICATIONS

"5×7 Double Picture Frame for Tabletop, Slide in Rear Backer—Silver" (DISPLAYSZGO) Nov. 17, 2015 (Nov. 17, 2015); retrieved from internet Jun. 4, 2018; <https://web.archive.org/web/20151117081709/https://www.displays2go.com/P-12957/Metal-Picture-Frame-Displays-Two-5-x-7-Prints>; entire document.

*Primary Examiner* — Ismael Izaguirre
(74) *Attorney, Agent, or Firm* — Leason Ellis LLP

(57) ABSTRACT

A system for mounting a covering (e.g., a fabric material) upon a frame is constructed from a plurality of elongated frame parts. Each frame part has two mitered ends and a channel formed therein. The related mounting method includes the steps of: (a) using a jig to hold the fabric material against the frame; (b) inserting a plurality of retaining splines within respective channels so as to capture the fabric material within the channels between one retaining spline and a corresponding floor of the channel, whereby a plurality of corner pleats are formed; and (c) using a tool to invert each corner pleat into a corner joint formed between respective adjacent frame parts so as to form an internal fold at each corner of the frame.

16 Claims, 25 Drawing Sheets

Related U.S. Application Data

Figure 1:
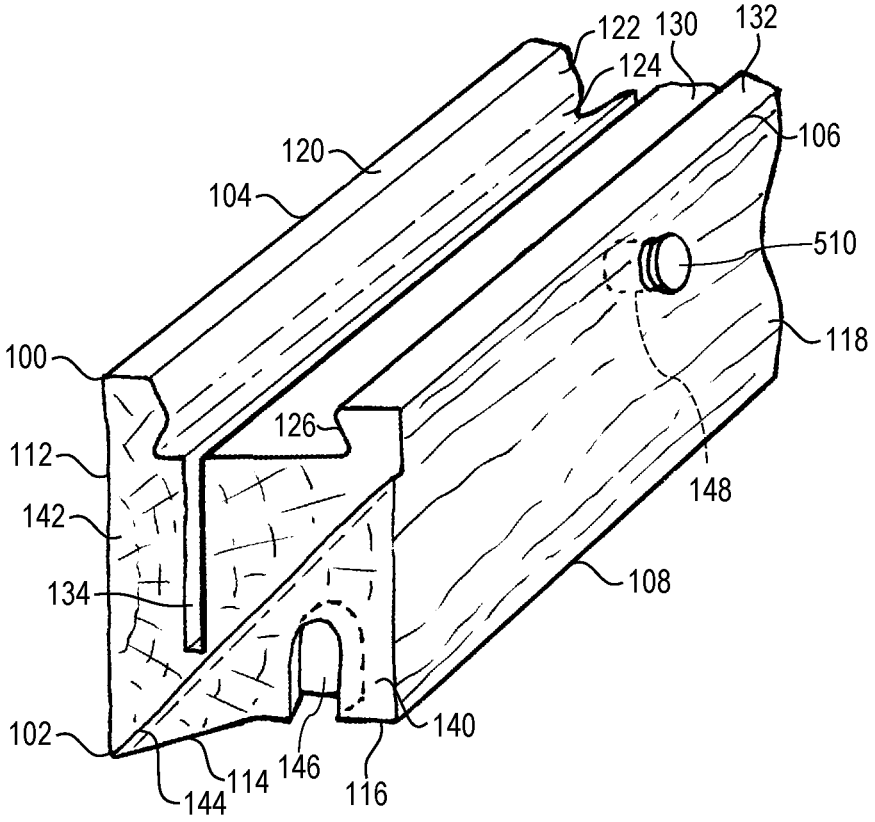

(60) Provisional application No. 62/335,751, filed on May 13, 2016, provisional application No. 62/231,969, filed on Jul. 21, 2015.

(58) Field of Classification Search
CPC .. A47G 1/10; A47G 5/00; B41F 15/34; B41F 15/36; E06B 3/96; E06B 9/24; F16B 12/02
USPC ..... D25/61
See application file for complete search history.

(56) References Cited

U.S. PATENT DOCUMENTS

| | | | | | |
|---|---|---|---|---|---|
| 2,567,743 | A | | 9/1951 | Stafford et al. | |
| 3,294,429 | A | * | 12/1966 | Halip | A47G 1/101 403/295 |
| 3,429,602 | A | * | 2/1969 | Dirilgen | E04B 1/2403 403/295 |
| 3,657,796 | A | | 4/1972 | Gochnauer | |
| 4,018,260 | A | | 4/1977 | Baslow | |
| 4,041,861 | A | | 8/1977 | Alter | |
| 4,144,660 | A | | 3/1979 | Lamb | |
| 4,197,686 | A | | 4/1980 | Baslow | |
| 4,451,997 | A | | 6/1984 | Jones | |
| 4,637,147 | A | | 1/1987 | Wolsey | |
| 5,058,353 | A | | 10/1991 | Gartner | |
| 5,075,991 | A | | 12/1991 | Wenkman et al. | |
| 5,275,224 | A | | 1/1994 | Morris | |
| 5,307,575 | A | | 5/1994 | Ivansson et al. | |
| 5,466,086 | A | | 11/1995 | Goto | |
| 5,502,906 | A | | 4/1996 | Yamawaki | |
| 5,579,595 | A | | 12/1996 | Dutton | |
| 6,138,741 | A | | 10/2000 | Stobart | |
| 6,189,252 | B1 | | 2/2001 | Dowzall | |
| 6,253,471 | B1 | * | 7/2001 | Strauh | B44D 3/185 160/381 |
| 6,722,096 | B2 | | 4/2004 | Von Arx | |
| 6,729,057 | B1 | | 5/2004 | Lu | |
| 7,735,541 | B2 | | 6/2010 | Ocampo | |
| 8,793,910 | B2 | * | 8/2014 | Froio | G09F 15/00 160/374.1 |
| 8,936,065 | B1 | | 1/2015 | Gillespie | |
| 9,402,488 | B2 | | 8/2016 | Morrish | |
| 2001/0014250 | A1 | | 8/2001 | Plummer et al. | |
| 2003/0200712 | A1 | | 10/2003 | Brownsell et al. | |
| 2004/0226208 | A1 | | 11/2004 | Kownacki et al. | |
| 2005/0129460 | A1 | | 6/2005 | Medcalf | |
| 2007/0245650 | A1 | | 10/2007 | Brown | |
| 2009/0031593 | A1 | | 2/2009 | Kasuya | |
| 2010/0147471 | A1 | | 6/2010 | Bull | |
| 2012/0090211 | A1 | | 4/2012 | Price | |
| 2013/0180142 | A1 | | 7/2013 | Kressin | |
| 2013/0333851 | A1 | | 12/2013 | Chen | |
| 2014/0352184 | A1 | | 12/2014 | Hall | |
| 2015/0297001 | A1 | | 10/2015 | Welch | |
| 2016/0296033 | A1 | | 10/2016 | Feltrin | |
| 2018/0199736 | A1 | | 7/2018 | Spiro et al. | |

FOREIGN PATENT DOCUMENTS

| | | |
|---|---|---|
| FR | 2 609 615 | 7/1988 |
| GB | 1 334 851 | 10/1973 |
| JP | S63 197585 | 12/1988 |
| WO | WO 2012/076370 | 6/2012 |

* cited by examiner

SYSTEM FOR MOUNTING A COVERING UPON A FRAME

CROSS REFERENCE TO RELATED APPLICATION

This application is a continuation of U.S. Ser. No. 15/265,417, filed Sep. 14, 2016, which claims priority to U.S. Ser. No. 62/231,969, filed Jul. 21, 2015, and U.S. Ser. No. 62/335,751, filed May 13, 2016, each of which is incorporated by reference as if expressly set forth in their respective entirety herein.

TECHNICAL FIELD

This invention relates to the area of stretching fabric over a frame, particularly in uses within the graphic arts. Such frames are commonly assembled from a set of four mitered wooden bars. In graphic arts, the mounting of the fabric to the frame can be performed before or after the application of graphic media to the fabric. The stretched fabric product can be displayed as a finished item, but can also be fit into a secondary frame or other housing.

Once tensioned, a blank fabric can be used as a flat working surface for fine art painting. An assembled frame can also be used or the mounting of preprinted fabric materials. Examples of such preprinted materials include both lengths of industrially produced printed fabric and individually printed impressions. In current practice, such discrete or short-run images are often printed upon compatibly prepared canvas by inkjet printing. Irrespective of the pigmented medium and graphic production process, stretched canvas images are used in fine art, commercial display, advertising, and both interior and exterior decoration.

BACKGROUND

Images printed on canvas are commonly stretched over an internal frame so that no part of the internal frame is visible in the images' final state of display. Because the frame commonly has an appreciable thickness, typically 15 mm to 50 mm, excess fabric inescapably gathers at the corners of the frame as the canvas is wrapped about the frame. When the fabric is to be placed into a frame, as is often the case with traditional paintings on canvas, this extra material is simply formed into a fold and fixed to the frames' outer surface, for example, by stapling.

It has become a popular practice to leave certain artworks in an unframed state for display. This allows the imagery to electively continue around the sides of the frame and provides a pleasing effect of depth and expansiveness. However, when a graphic image is displayed in this manner, the added bulk of a corner fold often remains visible. Furthermore, manually tensioning a canvas in the conventional manner requires tools such as canvas pliers to exert enough tension to discourage sagging of the fabric over time. This strategy therefore demands both strength and skill.

In the case of artworks of smaller scale, various methods and materials have been devised so that the appearance of stretched canvas can be given without significantly tensioning the fabric material. A considerable degree of effort has been directed to frames that employ precoated and often preprinted canvas that inherently lies relatively flat. This relatively stiff material can be assembled such that the extra corner material is cut and folded over the mitered faces of the bars prior to or during the assembly of the frame.

More specifically, small flaps of fabric are typically wrapped over each angled miter face at its acutely angled end. An attractive corner with a finished seam is formed when two such miter faces are joined at each corner. These artworks have become known colloquially as gallery wraps or studio wraps, and are popular and useful in both domestic and commercial decoration.

However, the typical gallery wrap process is currently laborious, and prone to error. Furthermore, certain steps in the process are irreversible. For example, a common current practice is to apply pressure sensitive adhesive (PSA) in tape form to two adjacent sides of the bars, and to their eight miter faces. In a first step, the outside faces are adhered to a precut piece of fabric in a rectangular layout.

Extra fabric is then cut away, and a diagonal slit cut at each corner at a 45° angle to the axis of the bars. The tabs formed by this slitting are then wrapped around the acute end of the miter faces, and adhered using a small patch of PSA. The bars are then rolled into a position so that their mitered faced meet and the parts clamped or pinned together into a rectangular frame.

While this process does produce a finished corner, it has several drawbacks. First, an assembler can easily mislocate the adherent parts upon the fabric. When this occurs, any mislocated parts must be removed from the fabric. In this case, the PSA often no longer adheres adequately, and the entire frame kit is necessarily and wastefully discarded. Furthermore, the fabric or its printed surface may be marred or damaged in any process of adjustment or reversal.

Second, the lack of a secure corner joint, owing to the intrusion of the fabric tabs and the resulting gap over the remaining area of the miter face, makes the assembled product prone to racking of the completed frame. Racking is the shearing in one plane, usually of a rectilinear framework, from its intended geometrical plan. In the case of fabric-covered frames, racking commonly leads to buckling or puckering of the covering fabric. Insecure miter joints can also result in a twisted frame in which the corners do not reliably rest upon a common plane.

Thirdly, when parts are assembled using PSA on the above-described manner, the fabric is not meaningfully tensioned, but instead is merely held as flat as permissible during the mounting sequence. This slack assembly state leaves the fabric prone to wrinkling and sagging, both upon completion of assembly, and upon the later effects of heat, humidity, and gravity.

Whether the assembler is a skilled framer or an amateur artisan, the unreliability of current methods often leads to frustrating, time-consuming, and costly complications.

Current practices of preparing gallery wraps therefore result in suboptimal acceptability rates, both during assembly of the frame and over the lifetime of the framed product.

SUMMARY

The invention may be understood to include two discrete functional elements. The first is a frame made up of bars having corner features expressly devised to allow an internal pleat of fabric to be received and retained within a partial slot disposed at the miter angle. The second is a jig that includes fences and insertion tools to assist in the accurate, attractive, and expeditious installation of fabric sheets upon compatibly devised frames.

An aspect of the invention is that a partial gap is left at the miter angles at each corner of a frame that is expressly dimensioned to retain a fold of fabric. When a fold of extraneous fabric is introduced into the gap, the fold is hidden from view and prevented from intruding on the flat appearance of the often visible sides of the covered frame.

The resulting arrangement thereby eliminates the massing of fabric that would otherwise occur if the extra material were to be tucked underneath the outer visible layer left and as an external fold. It also circumvents the complexities the common alternate solution of cutting the extra fabric material away and adhering the resulting tabs to mitered frame faces prior to the assembly of the frame.

The partial gap at the miter angle may be made at the actual juncture, of each instance in the frame, of two mitered rails. The partial gap may also be formed in an independently fabricated corner piece. The corner piece, for example, may be of injection molded plastic, and include the partial gap at the miter angle as a feature of each molded corner component. In this case, the rails may have substantially square ends that abut two adjoining faces of the corner piece.

Another aspect of the invention is an alignment scheme in which of two or more openings in an expressly prepared piece of fabric are cooperatively aligned with compatible relief features, such as raised pins or buttons, on a fixture receiving the frame or upon the assembled frame itself.

A further aspect of the invention involves the use of two cooperating parts on each side of the frame that entrap and tension the fabric over the frame. These parts include a larger bar, which may be made of wood or other material, which has been manufactured so that it has at least one channel formed within it. The frame may be devised to have a degree of flexure along at least one side of the bar.

The second cooperating part, which may also be made of wood, is a spline having a protrusion in its profile that is at least partially conformal to the channel. The spline is inserted in the channel with a fabric covering intermediate between the two parts, and by the application of mechanical force, the fabric piece is both tensioned and securely trapped between the parts.

Additional aspects of the invention are encompassed in tools and active work guides that assist in the speed, accuracy, and consistency of assembly. Guides of various types within this area of the invention pre-form the corner fold into a symmetrical bilobate shape so that a tool will invariably initiate an inversion of the fold in a symmetrical fashion. This operation may also be performed by hand.

In a particular comprehensive realization of the invention, a bladed tool with a fixed center of rotation rotates into the gap in the miter, catching and inverting the fold of extra fabric as it does so, and completes this action in such a way that the is fabric neatly hidden and prevented from binding anywhere along the fold. This operation may be achieved freehand using any simple, thin, flat instrument.

The invention also encompasses the use of raised fences to level the front face of the fabric and flatten the folded edges of the fabric against the sides of the preassembled frame. A fence system formed according to the invention, including at least one fence, may be fixed or may be individually or collectively displaceable, so long as the surrounding fabric is pressed against the frame as the previously combined frame and fabric are engaged with the fence system.

BRIEF DESCRIPTION OF THE DRAWING FIGURES

Figure 2:
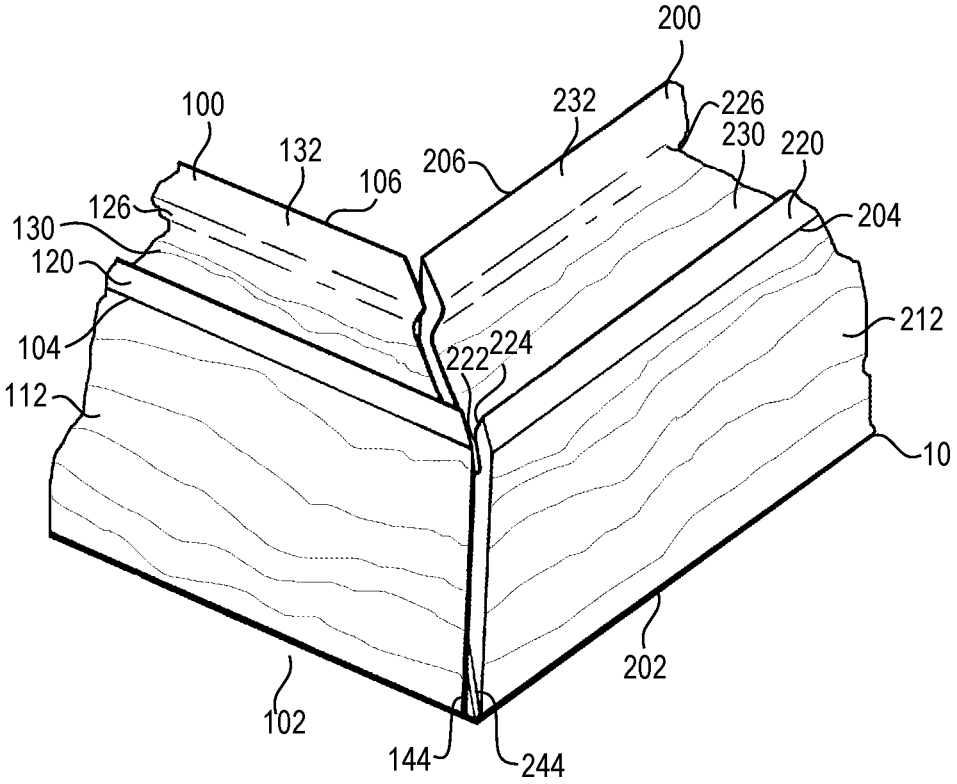
Figure 3:
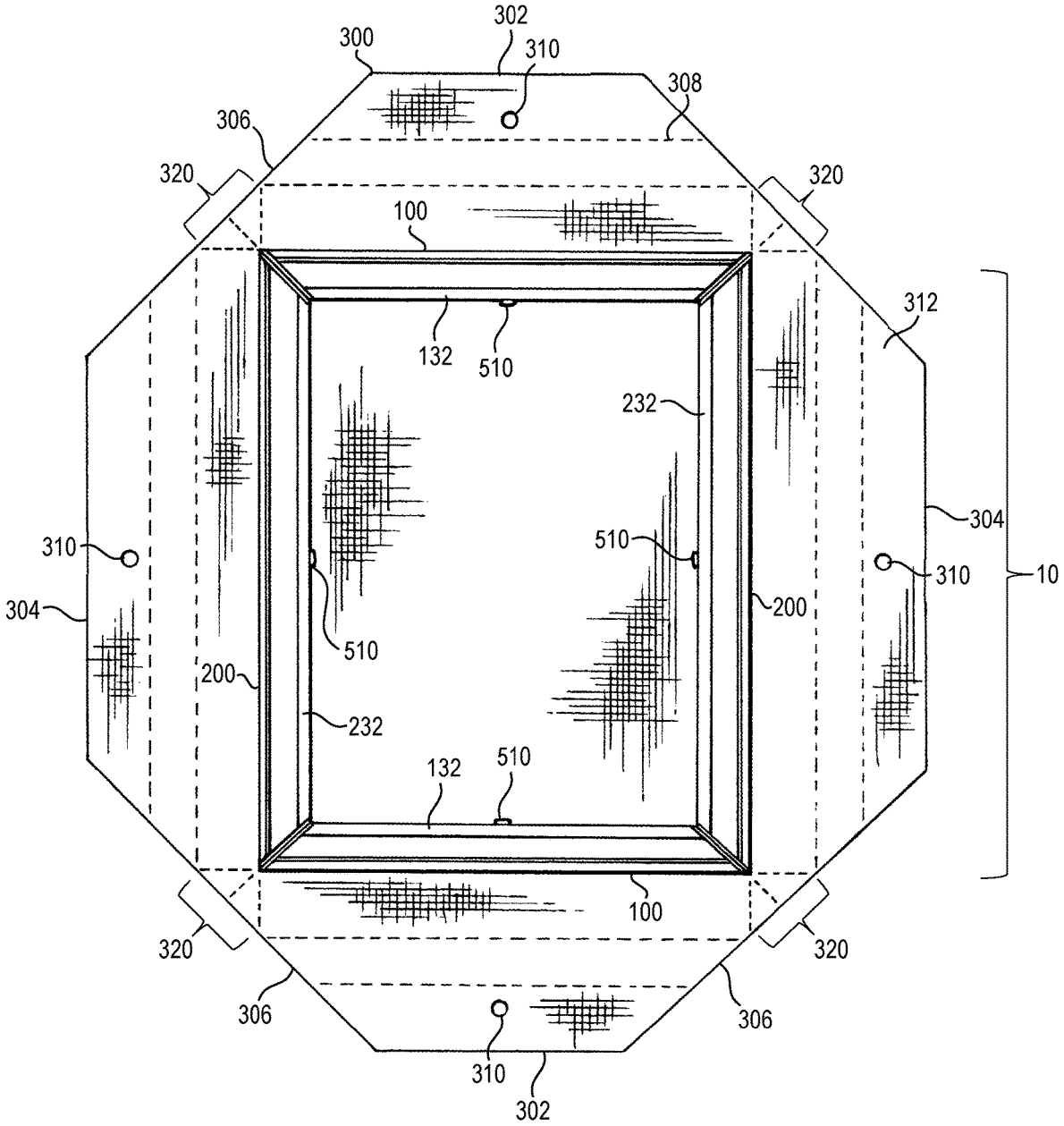
Figure 4:
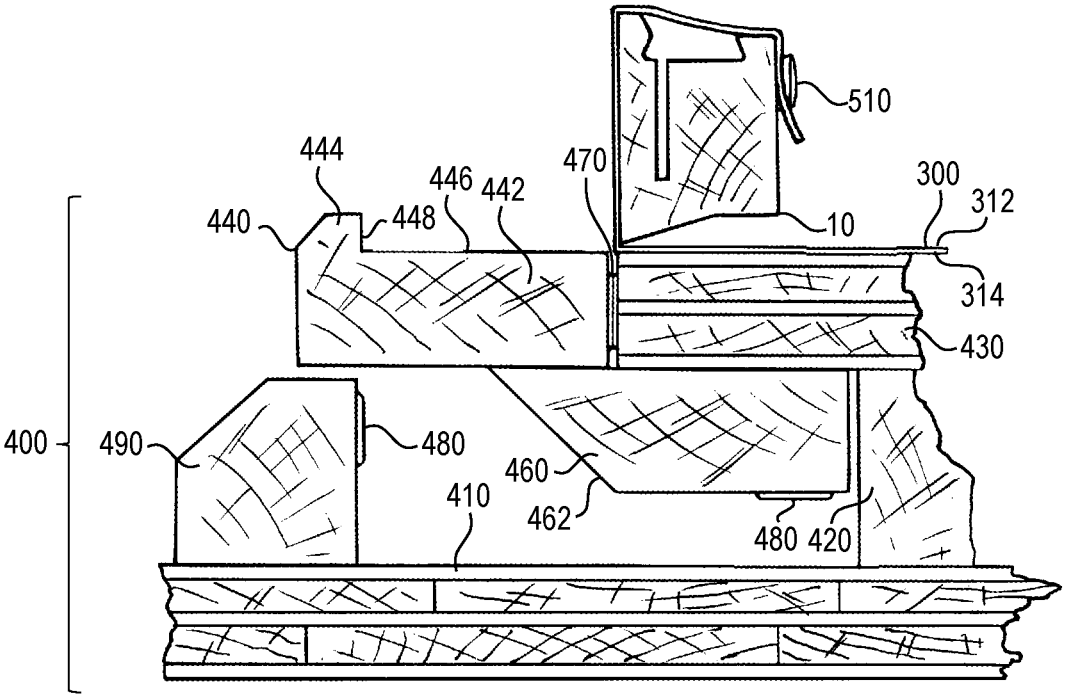
Figure 5:
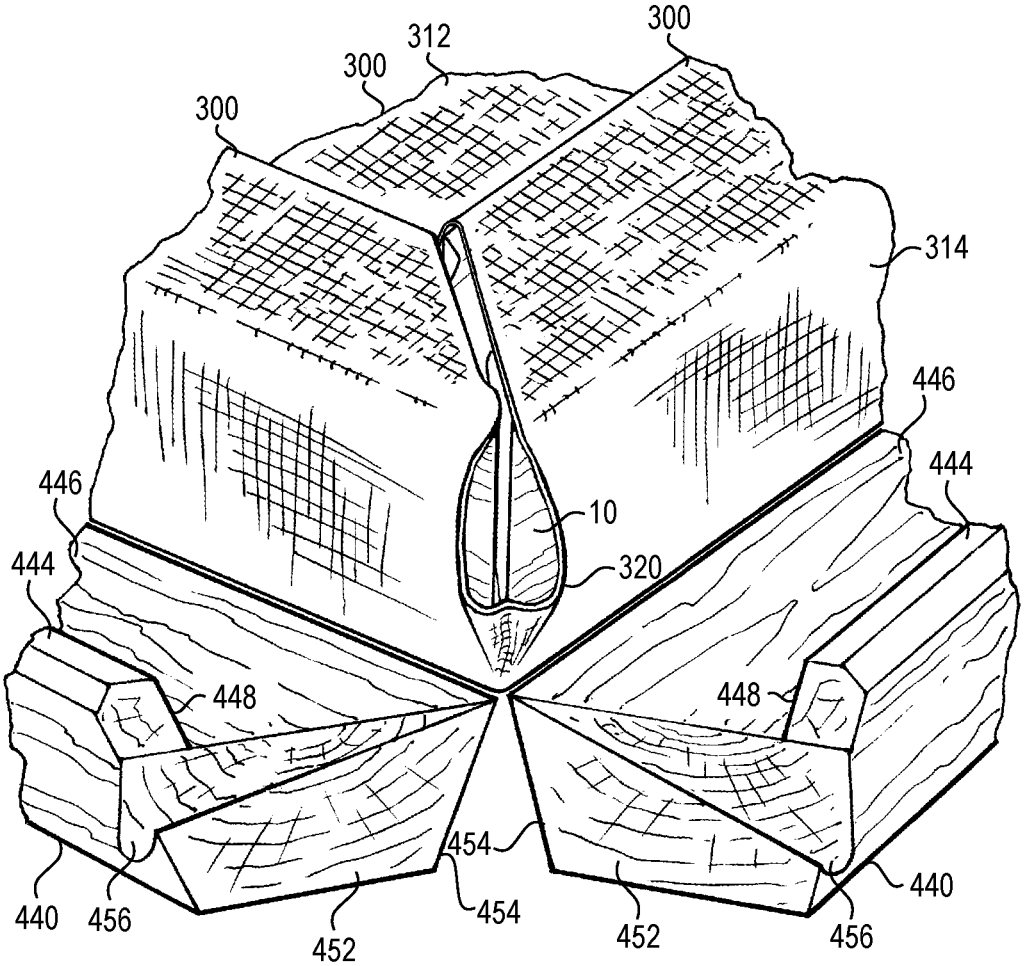
Figure 6:
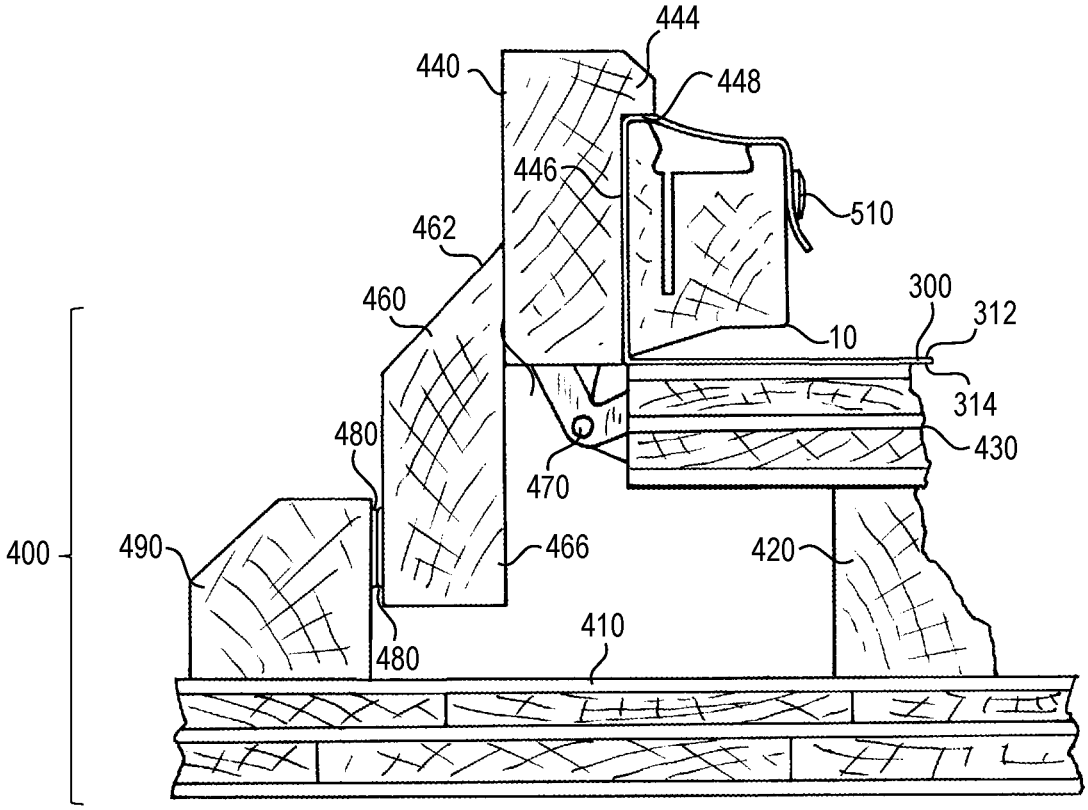
Figure 7:
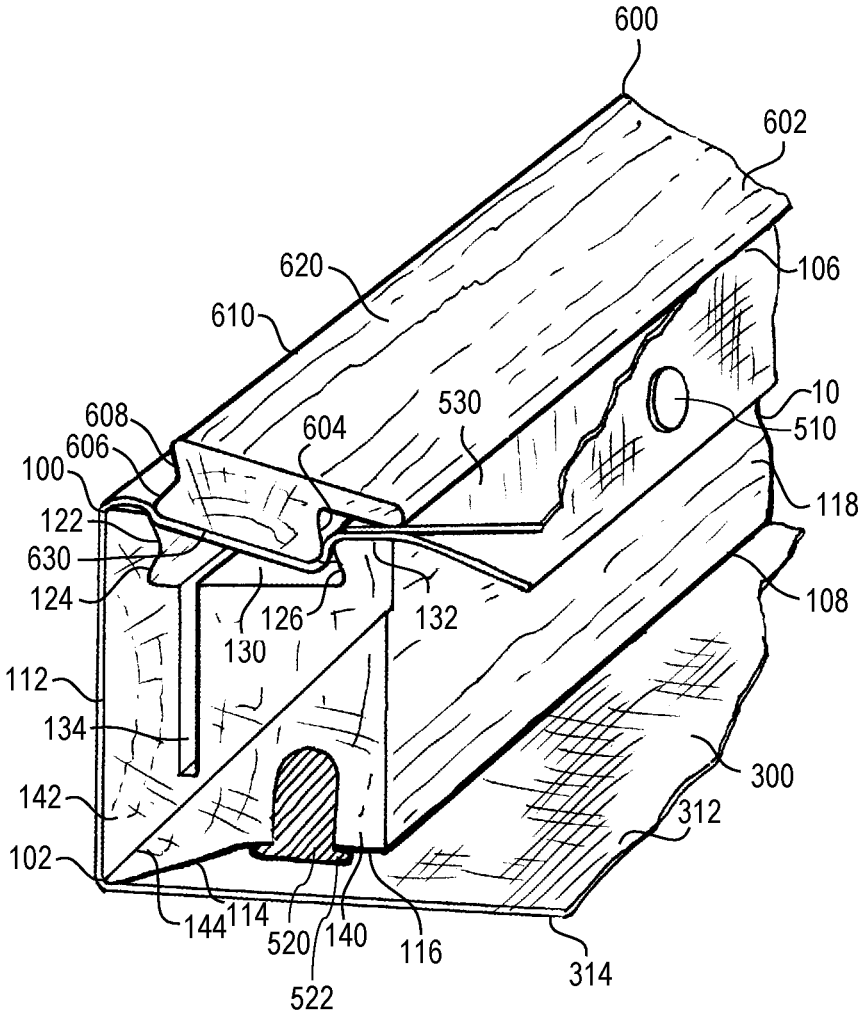
Figure 8:
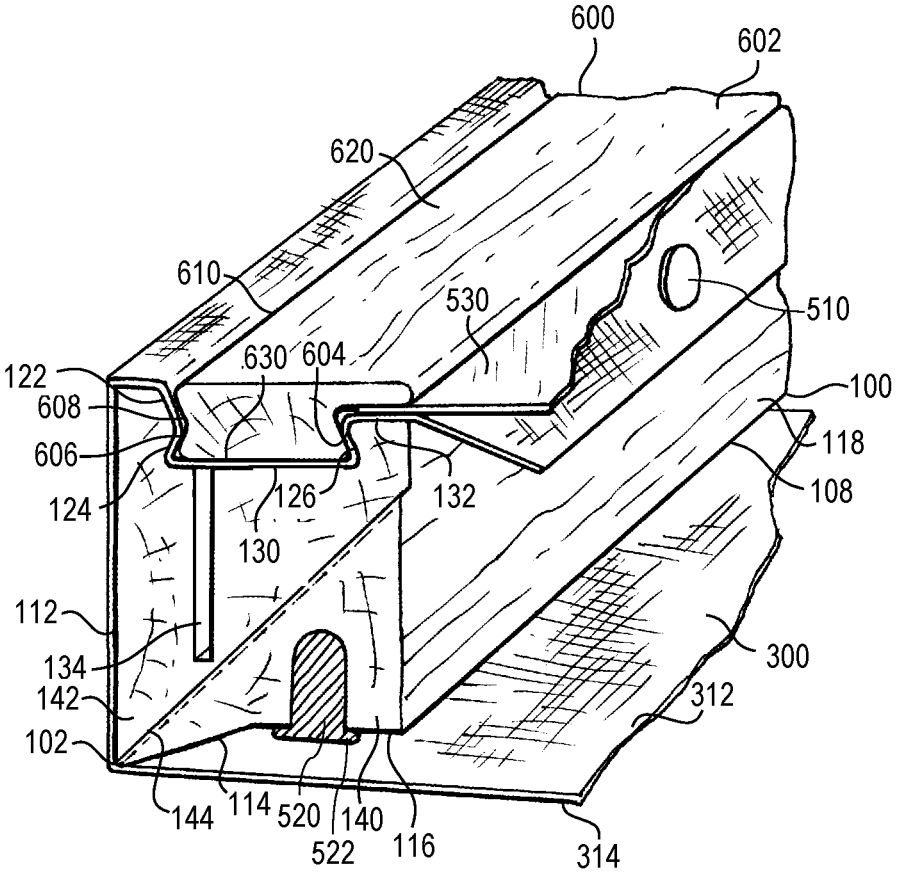
Figure 9:
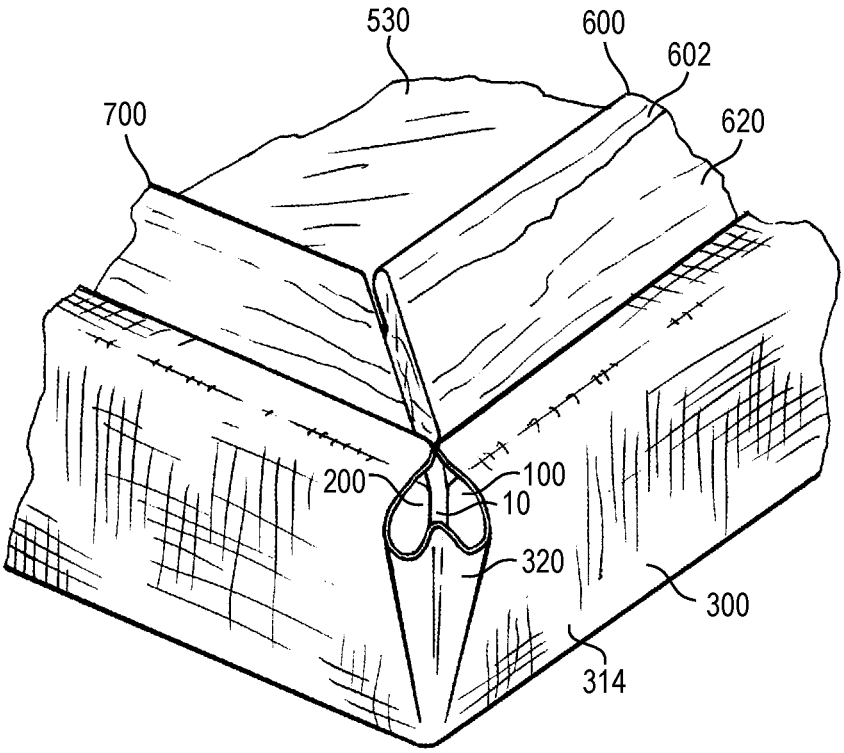
Figure 10:
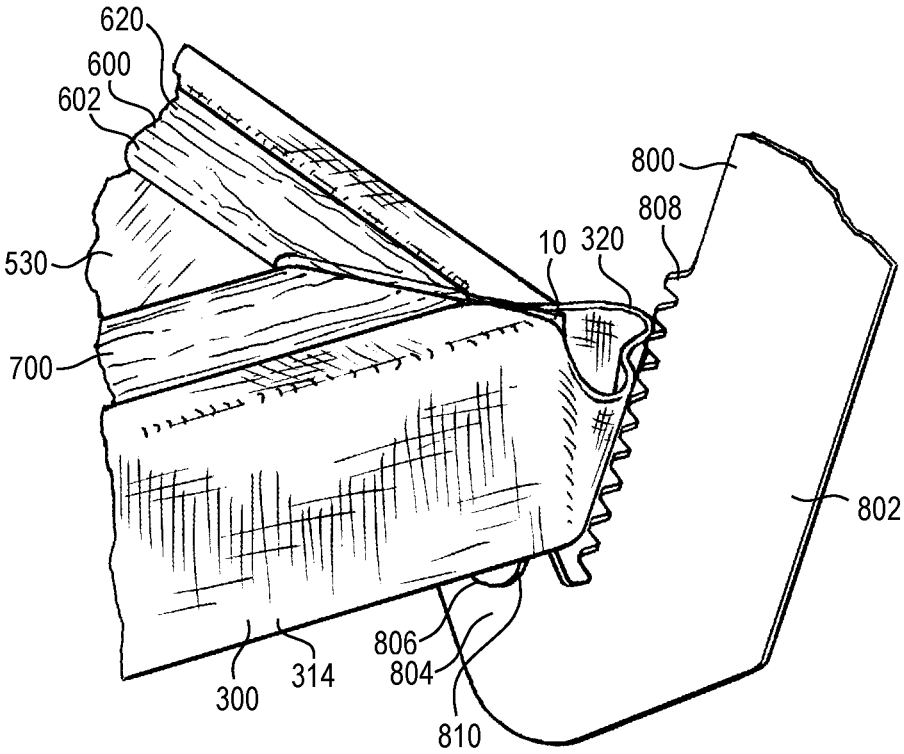
Figure 11:
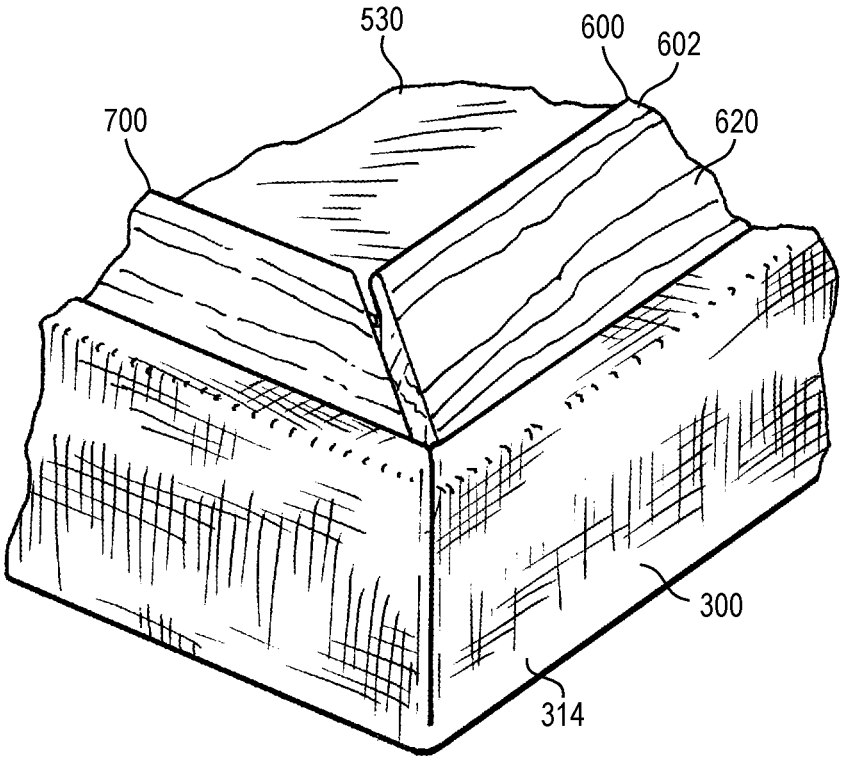
Figure 12:
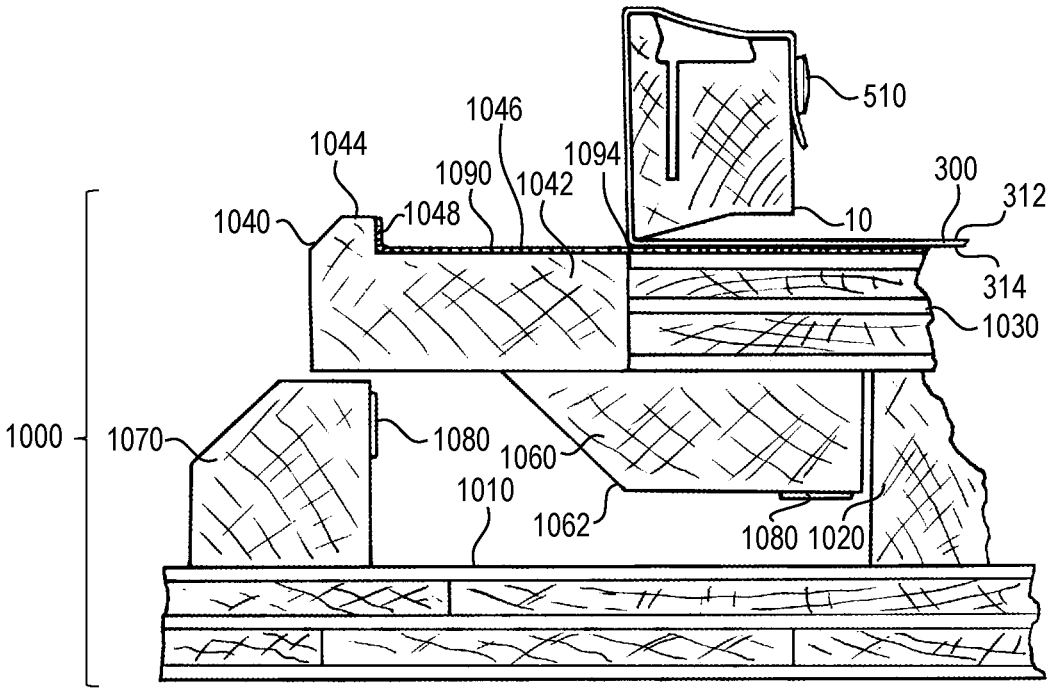
Figure 13:
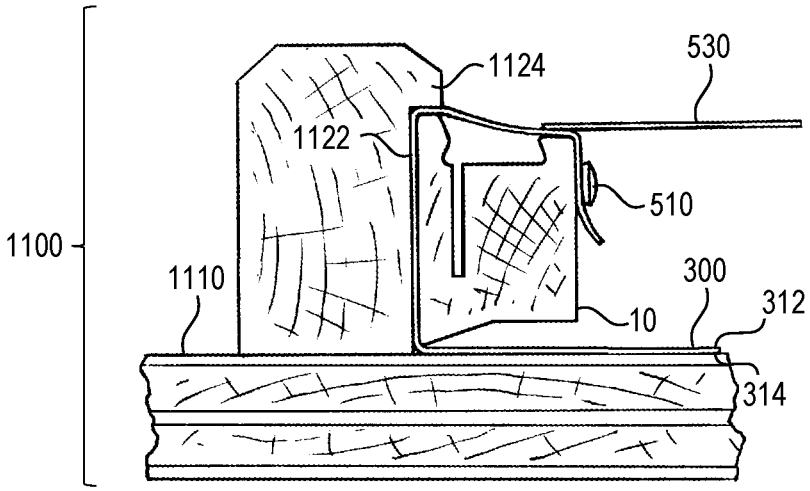
Figure 14:
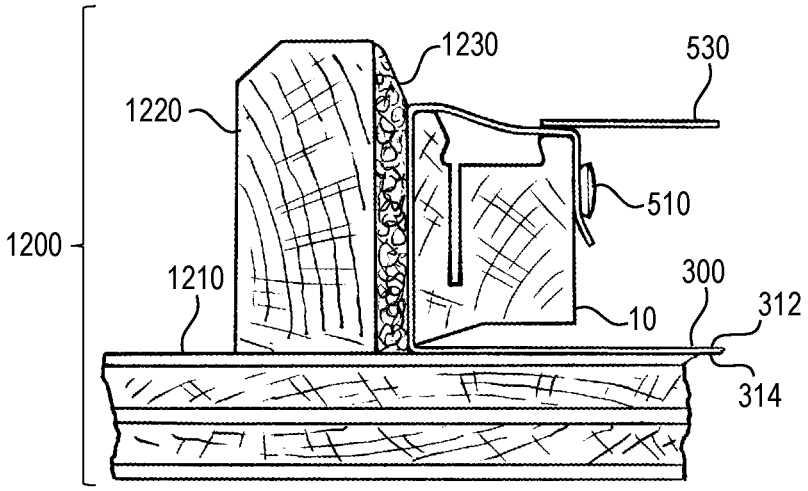
Figure 15:
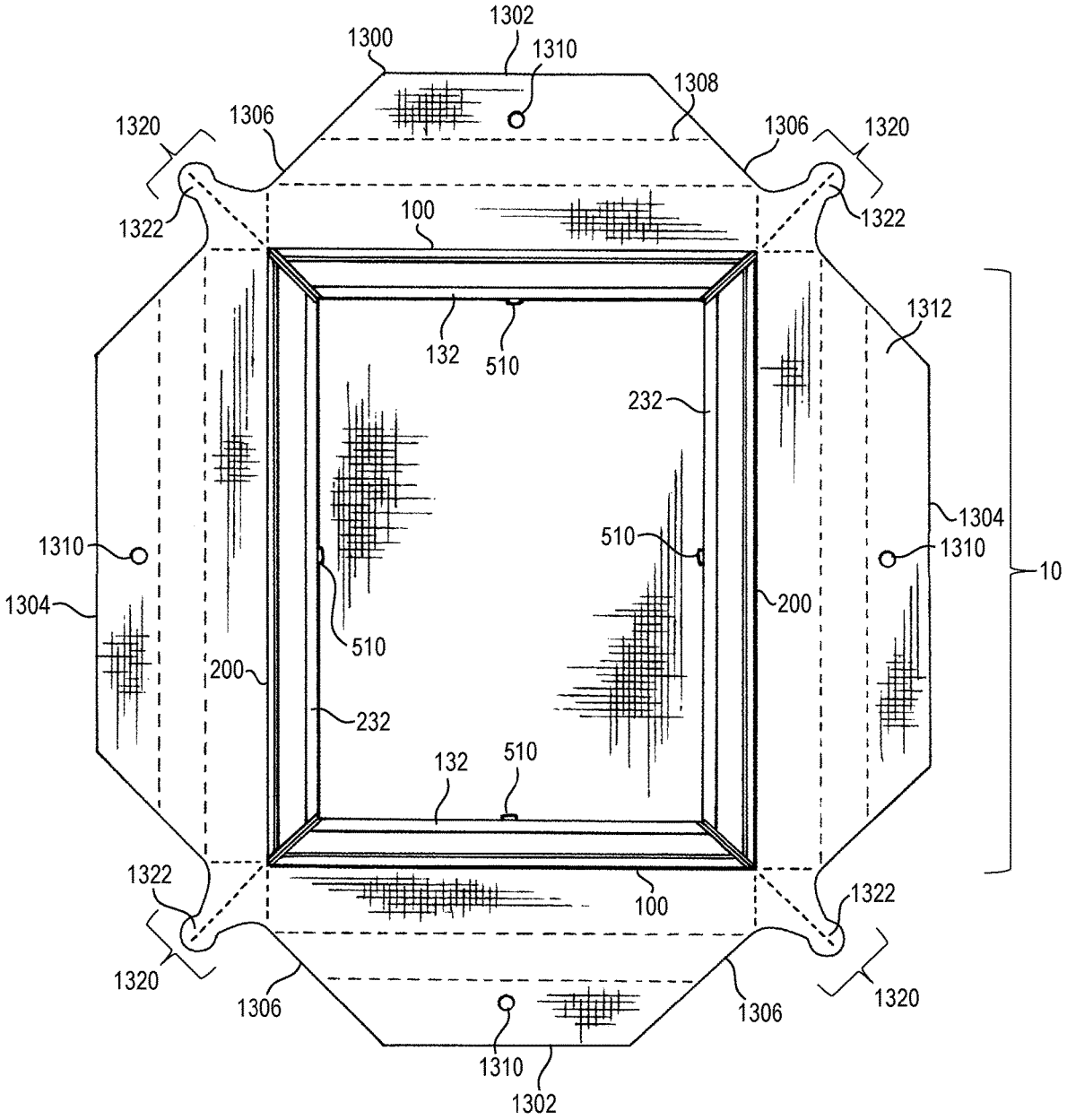
Figure 16:
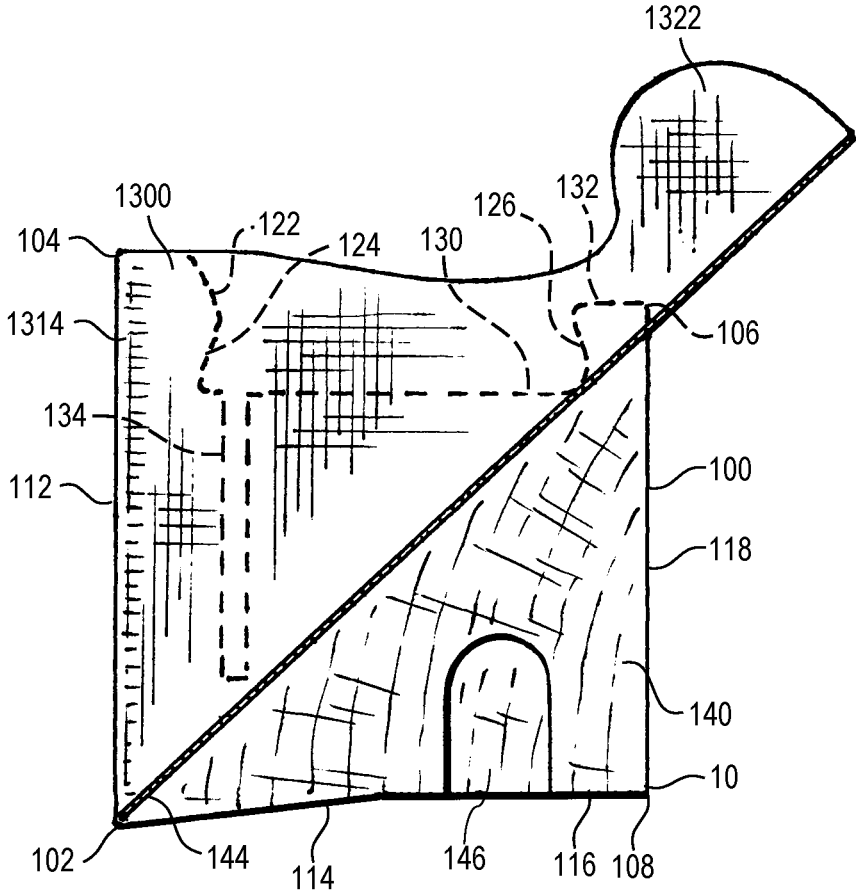
Figure 17:
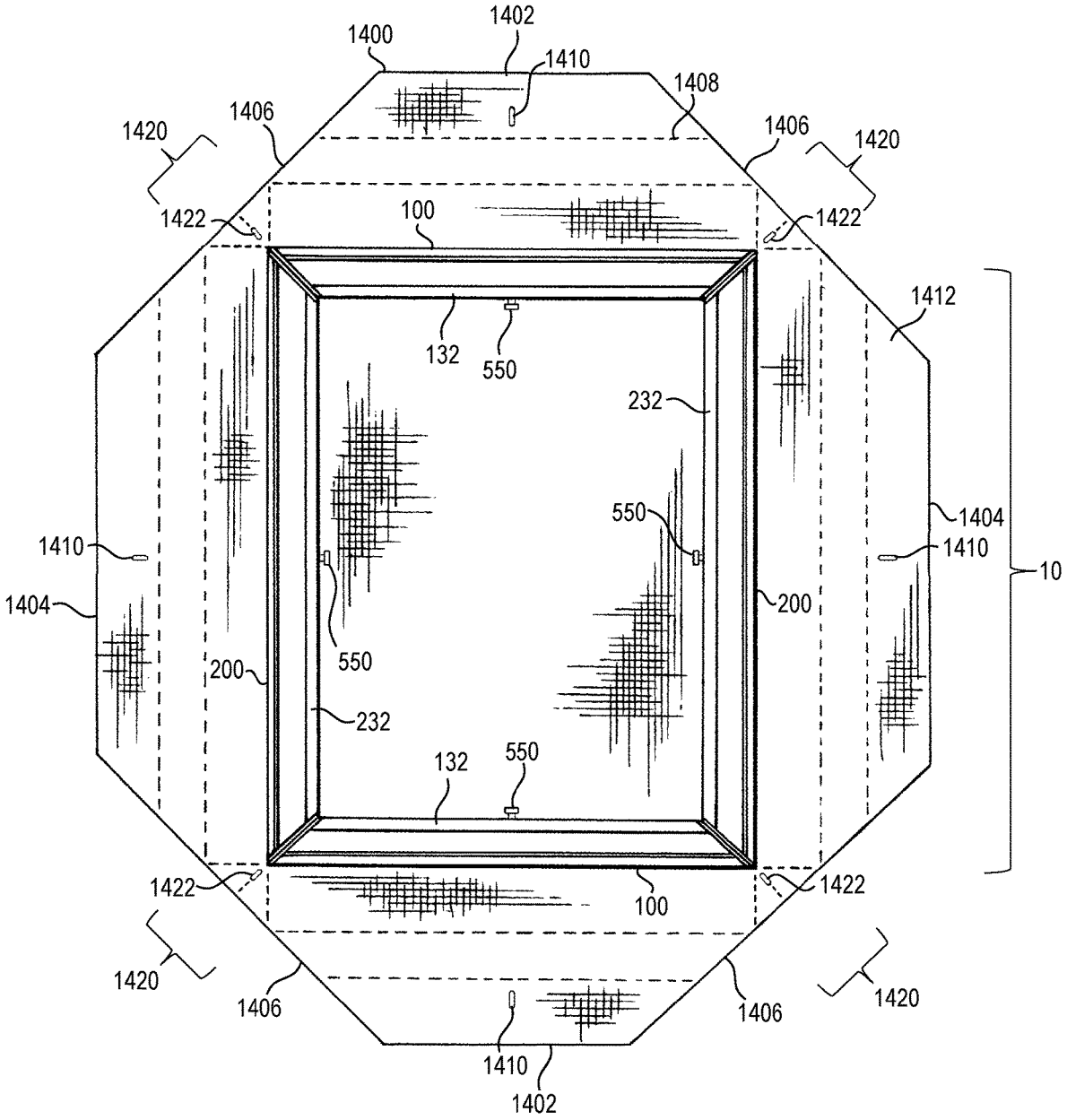
Figure 18:
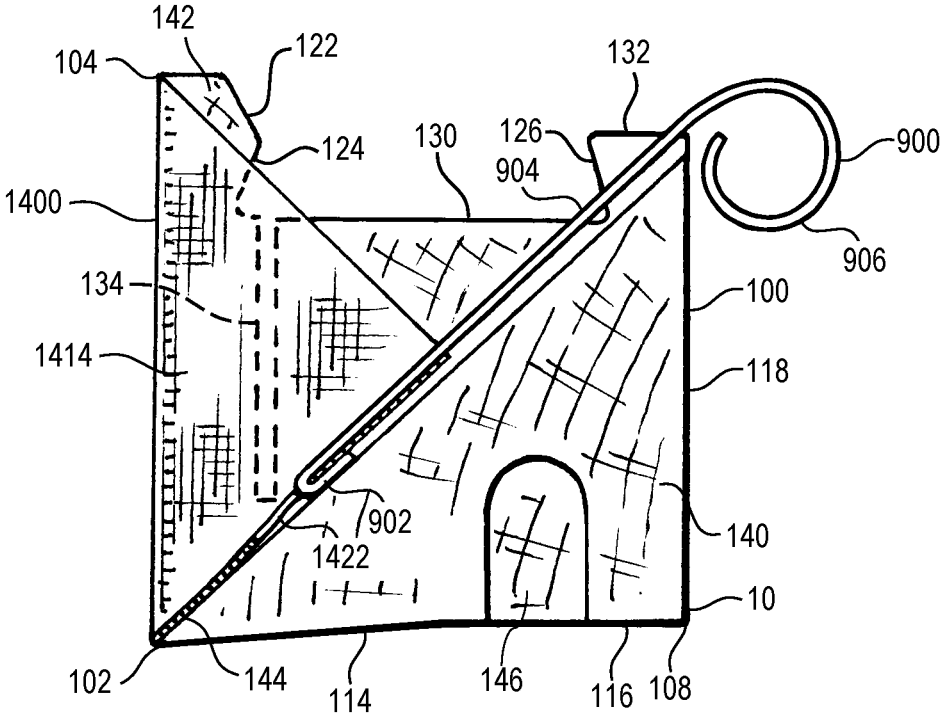
Figure 19:
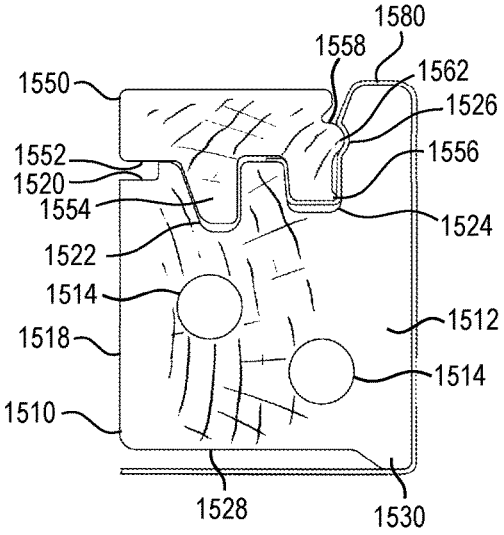
Figure 20:
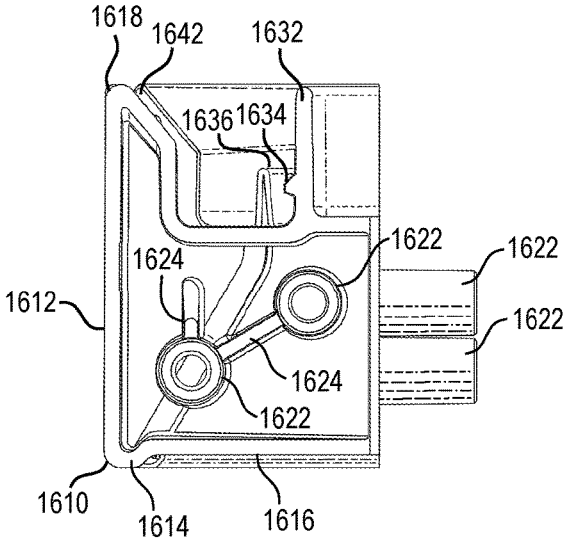
Figure 21:
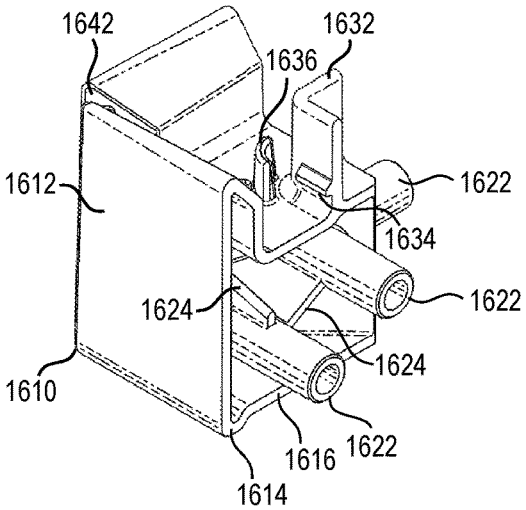
Figure 22:
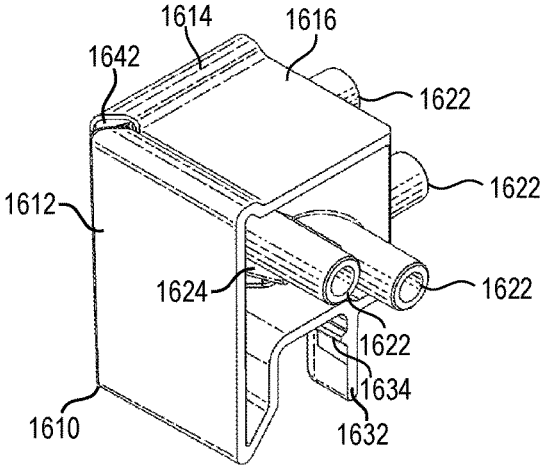
Figure 23:
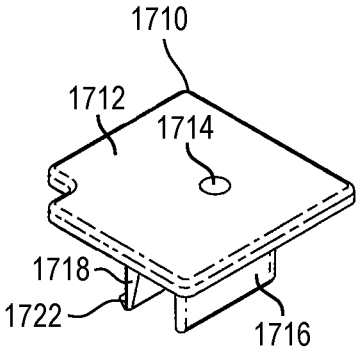
Figure 24:
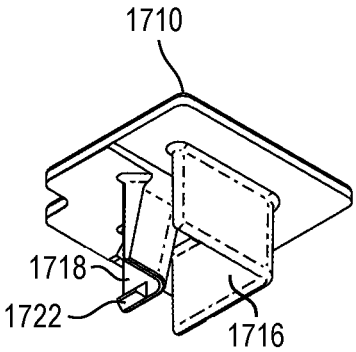
Figure 25:
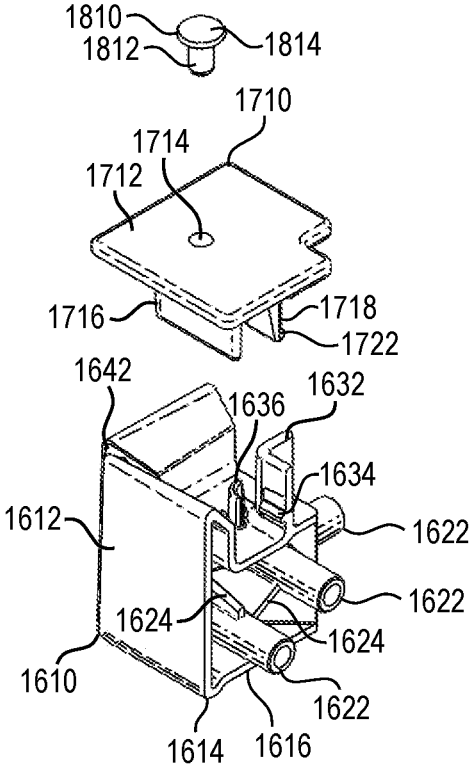
Figure 26:
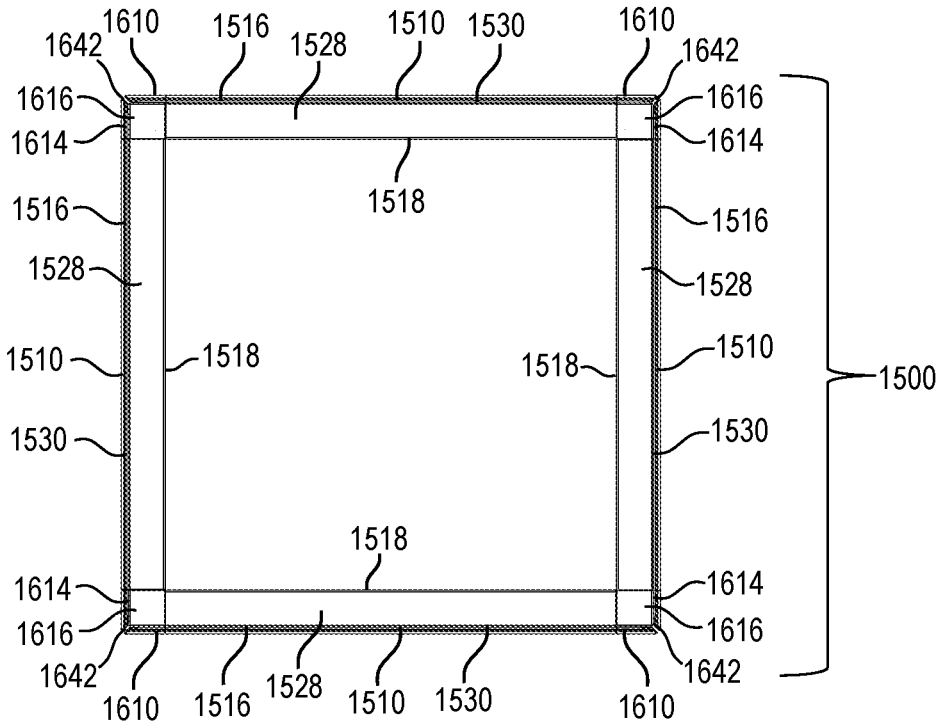
Figure 27:
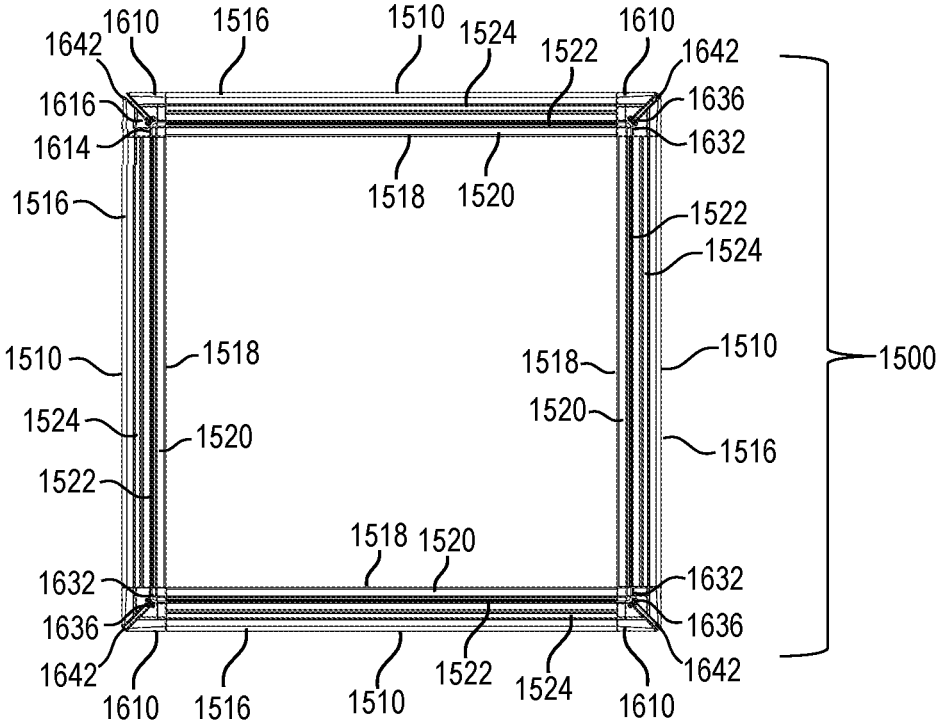
Figure 28:
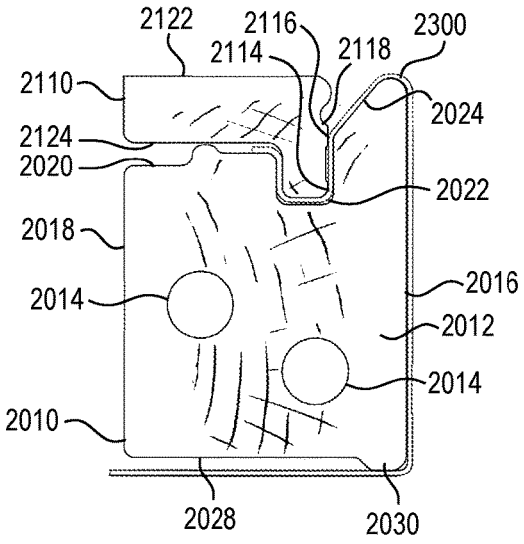
Figure 29:
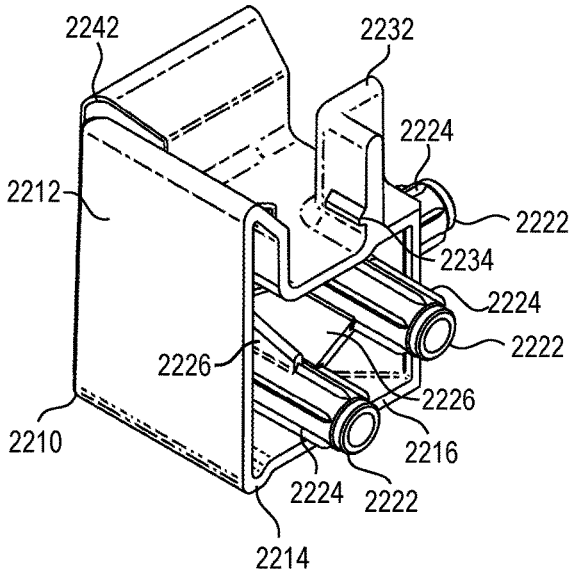
Figure 30:
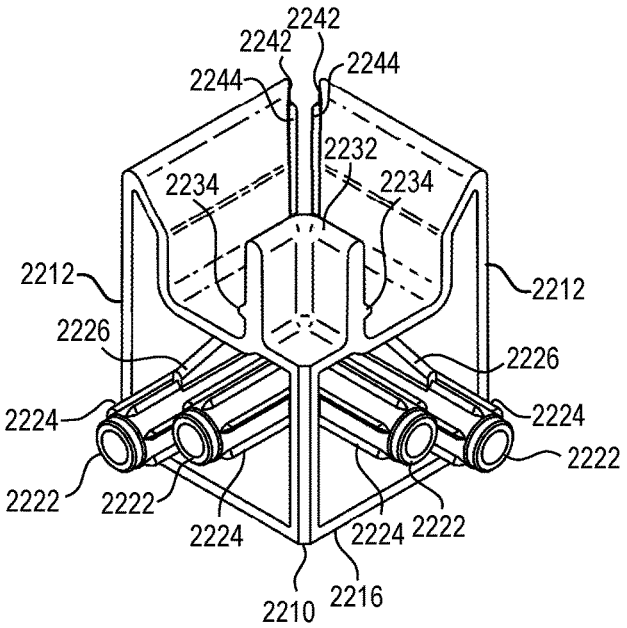
Figure 31:
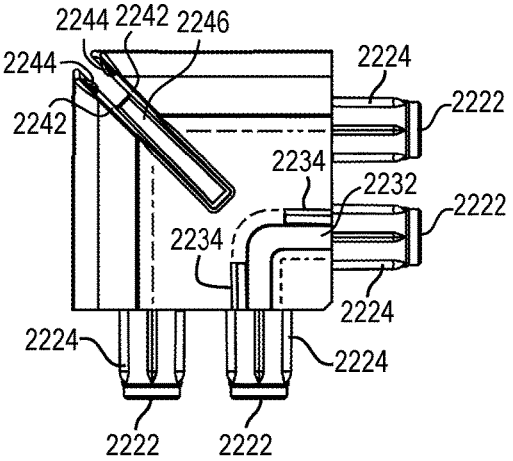
Figure 32:
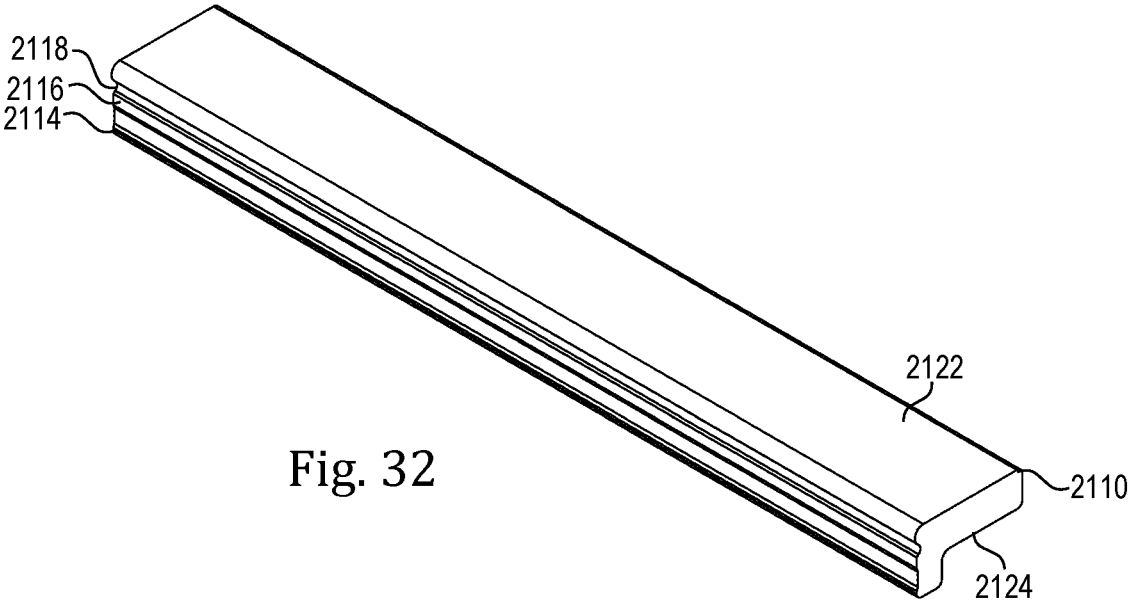
Figure 33:
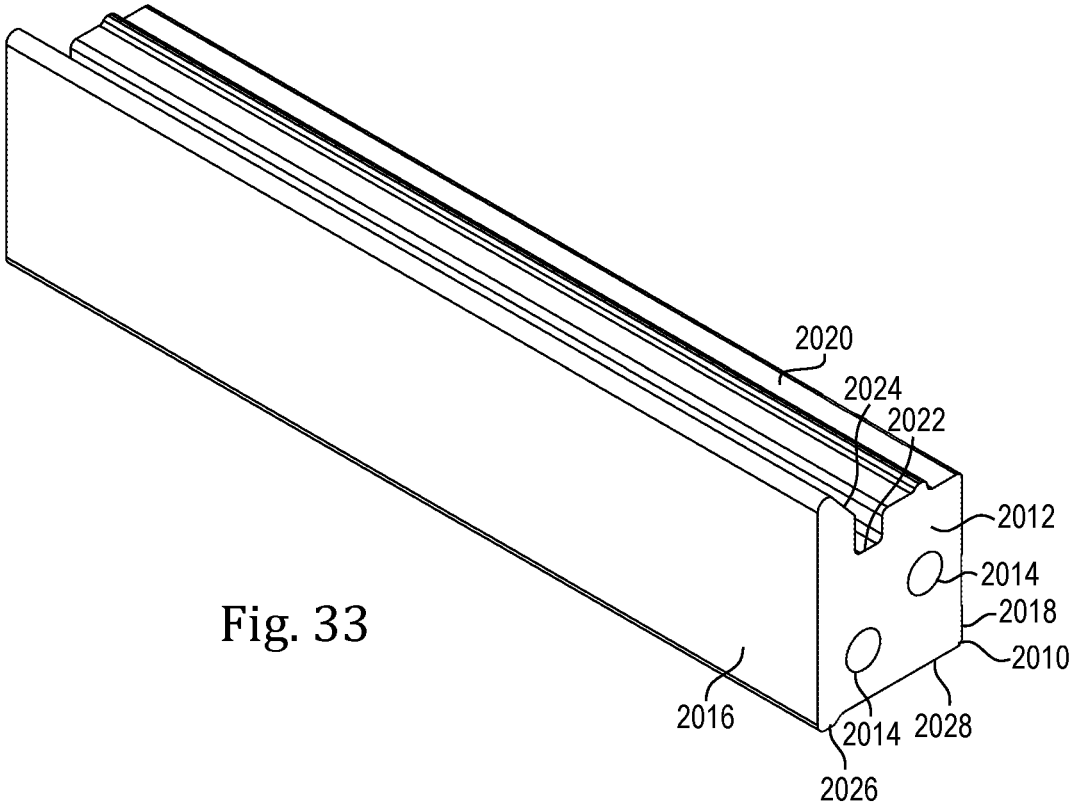
Figure 34:
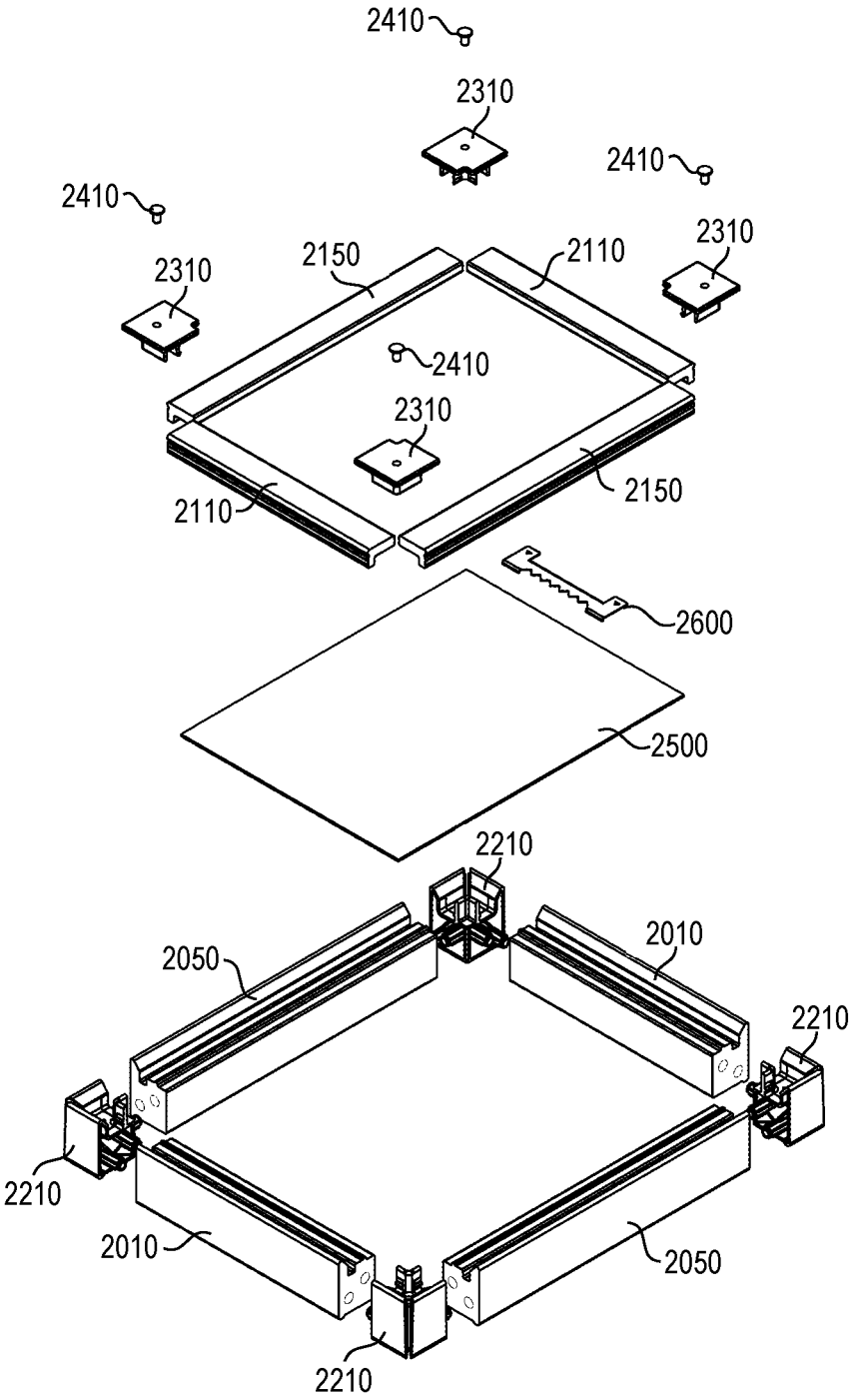
Figure 35:
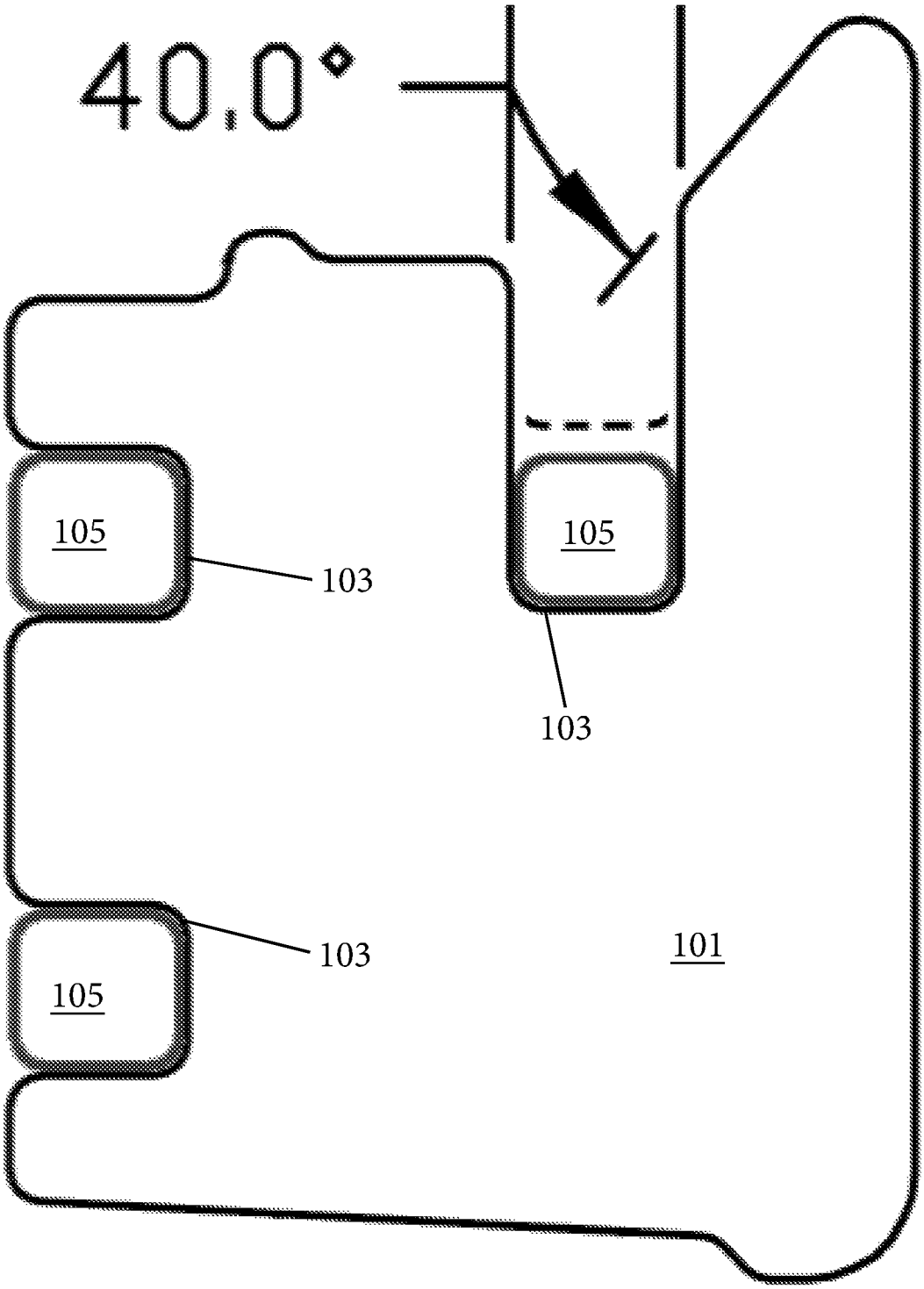

Further properties of the invention will be understood by reference to the detailed specification and its accompanying drawings, in which:

FIG. 1 is a partial perspective view of a wooden bar showing the bar and the inset mitered region devised to receive a corner fold, FIG. 2 is a partial perspective view showing two mitered parts joined to form a 90° frame corner, particularly showing the partial gap left at the miter joint, FIG. 3 is a plan view of the frame assembly, showing the initial placement of an assembled wooden frame upon a cooperatively prepared piece of fabric, FIG. 4 is a sectional view showing fabric piece wrapped loosely about the frame while being held in place by the location of the holes in the fabric over the pins in the frame, and also showing the placement of the frame assembly upon a folding jig, FIG. 5 is a partial perspective view of one corner of the loosely covered frame showing the location of the fold of extra fabric, and also illustrating the lifting of two adjacent guide fences against the wrapped frame, and furthermore showing concave recesses in the fence miters for preforming a bilobate corner fold, FIG. 6 is a sectional view of the folding jig corresponding to FIG. 4, with the fence in a raised position against the side of the frame, FIG. 7 is a perspective view of one side of a frame into which a spline is being inserted, the spline having its elevated edge initiating deflection of the outer sidewall of the frame part, FIG. 8 is a perspective view of one side of the frame into which a spline has been inserted, showing the spline entrapping the fabric and a backer panel, and showing the fabric entrained about the assembled frame in a tensioned state, FIG. 9 is partial perspective view depicting a back corner of the frame with the raised fences removed from view, showing the gathering of extra fabric at a corner into a bilobate fold, FIG. 10 is partial perspective view depicting a back corner of the frame, a bilobate fold being pleated and inserted between the miter faces by a tool formed according to the invention, FIG. 11 is partial perspective view depicting a corner of the frame, after the pleat has been invisibly installed within the miter, FIG. 12 is an image of an alternate jig design formed according to the invention with the fences in a lowered position, in which the fence hinge is made of cloth, FIG. 13 is an image of a second alternate jig design formed according to the invention in which the fence is fixed to a platen, FIG. 14 is an image of a third alternate jig design formed according to the invention in which the fences are fixed to a platen, in which the fences have facings of resilient material, FIG. 15 describes an alternate template for the layout of the fabric piece, in which the corners are provided with corner extensions in the form of tabs than can serve as tensioning implements within the invention, FIG. 16 is a sectional view of a miter employing the tensioning tabs illustrated in FIG. 15, FIG. 17 describes an additional alternate template for the layout of the fabric piece, in which the corners are provided with elongate holes than can work compatibly with a separate tensioning implement, FIG. 18 is a sectional view of a miter employing the tensioning implement inserted through an elongate hole in the fabric piece shown in FIG. 17, FIG. 19 shows a schematic sectional view of an alternative set of spline and rail profiles suitable for use within the invention, in which the spline has two distinct ridges which engage with corresponding troughs on a complementary rail, FIG. 20 is an end view of a molded corner piece employed in a modification of the invention, in which the miter angle is integrally formed in a prefabricated corner piece, FIG. 21 is an oblique back view of the part shown in FIG. 20, FIG. 22 is an oblique front view of the part shown in FIG. 20, FIG. 23 is a perspective view of the external side of corner cap for use with the corner piece shown in FIGS. 20 through 22 inclusive, FIG. 24 is a perspective view of the internal side of corner cap for use with the corner piece shown in FIGS. 20 through 22 inclusive, FIG. 25 is a partially exploded perspective view of a corner subassembly, showing a corner piece, a corner cap, and a bumper, FIG. 26 shows a front view of a frame assembled from four rails and four prefabricated corner pieces, FIG. 27 shows a rear view of a frame assembled from four rails and four prefabricated corner pieces, FIG. 28 shows a schematic sectional view of a further set of spline and rail profiles suitable for use within the invention, in which the spline has a single prominent ridge which engages with a corresponding trough on a complementary rail, FIG. 29 shows an oblique rear perspective view of a molded corner piece employed in an additional modification of the corner piece of the invention compatible with the spline and rail profiles illustrated in FIG. 28, including integral ribbed dowels, FIG. 30 shows an inner perspective view of a molded corner piece of the design illustrated in FIG. 29, FIG. 31 shows a rear view of a molded corner piece of the design illustrated in FIG. 29, showing a slot formed at the miter angle, FIG. 32 shows a length of the spline material included in FIG. 28, FIG. 33 shows a length of the rail material included in FIG. 28, FIG. 34 is an exploded drawing showing the main components of the frame system, absent the fabric piece, and FIG. 35 is a cross-sectional view of an exemplary rail with grooves for receiving integral pins of a corner piece.

DETAILED DESCRIPTION OF CERTAIN EMBODIMENTS

A frame for canvas is commonly made of four parts mitered at both ends at a 45° angle. In the invention, these mitered ends include relieved regions at the acute end of the mitered faces. The relieved area is typically in the form of a rabbet, recess, setback, or stopped partial kerf.

In the minimal case, the relieved area need only be commensurate with the actual fold of material as it rests with the miter after its insertion. However, for practicality of manufacture, the area may exceed the exact minimal dimension of the fold. The relieved area is therefore stepped into at least a triangular region adjoining the acute ends of the mitered faces.

The relieved areas are made in a plane parallel to the mitered faces in such a way that, when the main faces of two miters are placed in contact, a narrow partial slot is formed at the external corners of the joint. In commonly applied embodiments of the invention, the slot continues around so as to also be visible on at least a part of the back of the frame.

This relieved area allows a secure wood-to-wood joint that nevertheless leaves a narrow hollow proportioned so that the joint may, at each corner, accept and conceal a pleat of surplus fabric.

Bars formed according to the invention also have a channel cut into the back side of each bar, parallel to the length of the part. The channel serves to receive a strip of expressly chosen or devised spline material that is dimensioned to draw the fabric into the slot and retain it in a tensioned state. The channel and spline combination may electively vary in form and material, and may amenably include flexible snap features, undercut profiles such as T-slots or dovetails, or tapered features that wedge or jam the fabric into place.

The following detailed description details a wooden bar and mating wooden spline that cooperatively tension and trap the fabric, but many other configurations are envisioned within the invention. The spline may also be fabricated with a centered integral hanger, such as a T-slot or sawtooth pattern, either through the spline or along one of its edges.

A further aspect of the invention is the inclusion of graphical and structural features that assist in the relative alignment of the fabric and the frame. More specifically, a fabric component may be provided with an opening or set of openings that serves to align the material with a complimentary relief feature on an alignment jig or on the frame.

For example, a set of two perforations in the fabric and two commensurate round nails, pins, buttons, or dowels, located at opposite ends of their respective components, is typically sufficient to hold the fabric centered upon the jig or frame. Four pins may be used for further precision and redundancy.

When there is foreknowledge of the size of frame to which the image is to be applied, the shape and location of the holes can be identified by markings of appropriate shape, as may be digitally generated in a graphic arts software application, and as may be reproduced upon the fabric by an inkjet printer. Such a template may include additional indications, such as textual or symbolic instructions. An example of such an indicator is a peripheral cut-line marking the requisite outer contour of the fabric piece.

The raised alignment features to which the openings are fitted can be variously designed, and need not be a simply cylindrical in form. For example, in the depicted embodiment of the invention the relief element can usefully have a distinct head and a narrower neck so that the fabric is more securely retained. It may also have additional features such as annular ribbing on part of its exterior surface so that it may be press-fit into a compatibly dimensioned hole in the frame bars.

An example of a relief features that may serve as pins in the invention are metal nails such as escutcheon pins, staples, wooden pegs, or buttons having a "mushroom" cap. The shanks of such parts often pointed or tapered so they wedge securely in a hole in the jig or frame material. The hole may be drilled or can be made by the installation of the pin itself.

The pegs and holes combination can be deliberately devised so that the cap of the peg remains elevated above the surface of the jig or bar rather than seated flush against it. In this fashion, the opening in the fabric can be drawn over the cap and will tend to remain on the pin.

Another example of a suitable pin is a plastic device known as a push-pull rivet. These are two-part fasteners that include a rivet head and a collar that expands when the rivet is pressed into the collar. In particular, the type having a reverse chamfer provides a raised head about which a fabric alignment opening can be drawn. The push-pull rivet is so named and designed because it may be reversibly installed by lifting the raised head.

In the overall operation of an exemplary embodiment of the invention, therefore, a frame is assembled, the fabric is loosely aligned and centered on the frame, a fence raised against each side, and the fabric tensioned by the insertion of splines into a channels in the back of the frame. The splines may be advantageously designed to retain a prefabricated dust cover of a stiff material such as cardboard.

The four mitered wooden bars may be assembled by diverse joinery methods. Dedicated joinery systems are commonly used in the assembly of picture frames and stretcher bars, and are amenable to use in combination with the invention. Such systems may be obtained from Hoffmann GmbH (Bruschal, D E). Hoffman joinery systems, such as the MU2 machine, cut a dovetail slot into the face of each miter so that an expressly formed plastic or wooden key can be used to tie each miter together. Diverse parts for frame joinery are also available for the Nielsen-Bainbridge frame joinery system (Austin, Tex., USA). Other methods, such as metal clips or staples, are also effective in combination with the invention.

The conventional practice in frame joinery systems such as the Hoffmann MU2 is to have a dovetail cutter enter from the back of the frame. In the present invention, the cutter may be advantageously entered from a recessed face upon the front of the frame part. This location provides the maximum joint security while still allowing the unimpeded acceptance of extra fabric material between the mitered faces.

Hoffmann GmbH part W9211400 is a plastic key that includes a flange that stops the entry of the part and allows its removal with the help of an appropriate bladed tool, such as a flexible putty knife. This class of fitting is useful within the invention in that it allows nondestructive disassembly of the frame.

Irrespective of the joinery method employed, once the bars are assembled into a rectangular frame, the frame is laid upon a compatibly prepared sheet of fabric, i.e., one within a certain dimensional range relative to the frame dimensions, and having its corners removed at a 45° angle to form an octagon of a particular proportion relative to the frame.

The fabric is then folded over the sides of the frame at the front edges of the bars, e.g. so that the side fold is perpendicular to the main plane of the image. If the fabric is thus drawn and held against the side of the frame, the operation induces pleats of extra material to form at the diagonally cut corners of the sheet.

The fence in a subset of illustrated embodiments of the invention is formed with a lip so that edges of the fabric sheet are wrapped over the back of the frame, forming a second fold so that the edges of the fabric overlay the channels made in the back of the bars. The lip on the fence initiates the fold, but is dimensioned so that it does not intrude upon the channel into which the spline is inserted.

Compatibly devised splines are inserted into each channel with, in each case, a flap of fabric material and a rigid backer panel intermediate between the spline and its receiving groove. The splines are then pressed into place. As the fabric is drawn into the groove, it is also drawn in tension over and about the frame. When the insertion of the splines is complete, the fabric is trapped and held in a state of tension upon the frame and the backer is firmly entrapped along four sides.

In the present invention, the extra fabric material gathered at the corners is entered into the expressly-formed corner slots using a thin, flat tool, until the pleat is progressively inverted, until the reversed pleat is seated flat and fully hidden within the miter. In a typical rectangular frame, the fold line achieves an angle of 45° within the slot relative to and against the relieved faces of the mitered bars. Owing to the housing of the corner pleats within the miters, only a tight perpendicular corner seam is left visible at the exposed corners of the wrapped frame.

The process described in the above-recited embodiment is readily reversible, as neither adhesives nor permanent fixing hardware is used in the assembly. The splines can be removed from their receiving channels, the fabric released, and each corner fold withdrawn from its compatible corner slot. The keys can be removed from the miter joints. Furthermore, the operations described above can be performed in a diversity of sequences, according to the preference of the operator and practicalities associated with the dimension of the product, the weight of the fabric, the necessary orientation of the frame, and the availability of working space.

For example, it may be preferable in certain circumstances insert of the corner folds prior to stretching the fabric. In general, the order of operations within the invention should be understood to be mutable and transposable. Also, it is a previously noted advantage of the invention that its assembly process may be interrupted or reversed to allow adjustment, correction, or refinement. Therefore, the descriptions of the order of work in the embodiments herein described should be understood as being directed to a procedural and schematic expression of the invention, rather than as a limitation upon the variety of its methods.

The second functional element of the invention is a jig that assists in the mounting of the fabric upon a frame. An embodiment of the jig includes displaceable fences for pre-forming fabric folds. It also includes dedicated bladed tools that may be used in place of thin-bladed hand tools that might alternately be used to manually invert the folds of extraneous fabric into their corner recesses.

In the general practice of mounting fabric on a frame, a fabric material such as a canvas must be folded at 90° over the edges of its accompanying frame. The edges at these locations are relatively sharp. As a result, the fabric material must at some point be abruptly and conformally turned against the wooden bar, with no looseness or volumetrically meaningful radius in the fabric along the bar's front outer edge.

Therefore, in the making of a folding jig, a conventional hinge cannot be located along an edge without intruding on the physical volume necessary for making a tight fold along the edge. However, a further difficulty arises if the rotational axis of the hinge is set away from the frame edges, as this invariably increases the total length of the fence's path of travel. Instead of flattening the fabric against the frame, the longer travel path results in a binding or pinching of the fabric at the edge when the fence encounters the fabric.

The invention therefore envisions the use of hinges with an offset turning centerline, more particularly, an offset centerline that occurs in free space rather than about a physical component such as a hinge pin or axle. Such hinges are known, and are most typically for the purpose of concealment of the hardware itself. They typically operate through the use of a plurality of pins or turning centers rather than a single axle used in conventional hinges. However, within the invention, these hinges are used to allow supporting fences to be attached to a base and then turned up against the side of a frame during mounting of a fabric piece, without intruding on the volume necessary to complete an abrupt 90° turn of the fabric about the frame.

Indeed, as noted before, a suitably formed fence can not only makes a fold over the front edge of the frame, but may also initiate a fold over the back edge. Furthermore, the friction of the fence can retain the fabric with a limited degree of tension so that the fabric is free to be further tensioned by the insertion of the retaining splines. The jig includes latches, such as those formed using magnets, which hold the fences in a momentarily upright position.

A jig employed within the invention also leaves an intentional separation where fences meet at mitered corners so that a tool can be introduced to maneuver the folds at the corners into their receiving slots. Such tools can be made a permanent part of the jig assembly, for example, in the case of a rectangular frame, being installed such that they are held in guides that preserve an insertion angle of 45°.

Such a tool and guide arrangement can impose a direction of travel upon the tool that discourages binding or jamming of the fabric at the corner folds, and roughly equals the tension imparted by the installation of the splines in the bars. Generally speaking, a tensioning force is applied obliquely to the fold by a tool following a radial path, so that the bladed tool in such a manner that the tool in effect advances along the fold line as well as against it.

A radial path with its center of rotation below the frame allows the tool to intrinsically engage the fabric in a progressive fashion, e.g. by tightening the fabric first at the visible outer corner and then finishing the action at the hidden inner point of the fold.

In the invention, fence elements can also include guide surfaces so that the extra fabric at a corner is preshaped into a cardioid or bilobate shape. This preshaping prepares the material for folding of the pleat into equal halves by a tool as it is advanced and the fold introduced into the miter.

Further details of the invention will be understood from the following description, and its accompanying figures and their corresponding reference numerals.

In the following description, each bar used in the frame has four sides. If the assembled frame were to be mounted in the conventional manner on a vertical wall, the front sides would face a viewer, the back sides would face the wall, the inner sides would face the geometrical center of the frame, and the outer sides would face up, down, left and right. This nomenclature of orientation is used throughout the following description, irrespective of the orientation of the parts during assembly.

Commonly, a set of bars will consist of two pairs of bars of differing only in length. These elements are differentiated in the following descriptions by the use of dimension "A" and dimension "B". In the case of a square frame, the four bars would be of the same length.

While this specification mainly describes rectangular layouts, the invention also anticipates special cases in which the corners are other than right angles, the miters other than 45°, and the shape other than rectangular, and anticipates that bars, fabric pieces, and other components can be made and compatibly configured for such circumstances within the scope of the present invention.

In the following application of the invention, the frame design is rectangular in form. A set of bars therefore includes four bars. In accordance with the invention, each wooden frame part includes a conscientiously formed channel on its back side.

In each of the four bars, a narrow kerf that exceeds the depth of the channel is formed in the bottom of the channel. Its location is typically toward the outer side of the frame part. The proportion and location of the kerf location allow a degree of deflection in the outer wall of the wooden frame part such that a second mating part, a spline, may be captured and held within the channel. The cooperatively formed frame part and spline may be understood to act as an elongated snap fastener. As in a snap fastener, the length and slope of the entrance and exit faces of the relevant parts can be varied to regulate the tensioning capacity, holding ability, and requisite extraction force.

Referring now to FIG. 1, exemplary "A" length frame 100 represents a mitered bar (i.e., a mitered bar having a first length). Dimension "A" frame part 100 may be conveniently milled out of wood by sawing or through the use of molders, shaper, routers, CNC equipment, or combinations thereof as is known and practiced in the art of wood manufacturing. Analogous or functionally equivalent parts may be extruded, stamped, rolled, or otherwise formed from metal or plastic. In the following discussion, it should be understood that recesses and rabbets can be formed as steps or angles in geometrical shells such extruded or molded components, and the use of terms of convention does not imply any limitation on the process of the manufacture of the representative surfaces.

The illustrated bars include four defining edges. These edges are dimension "A" frame part front outer edge 102, dimension "A" frame part back outer edge 104, dimension "A" frame part back inner edge 106, and dimension "A" frame part front inner edge 108. Dimension "A" frame part front outer edge 102 is here raised to elevate the stretched canvas and discourage telegraphing of the sharp front inner edge 108 through the canvas, whether during mounting or over time.

Dimension "A" frame bar 100 also includes several faces. Faces include "A" outer face 112, "A" sloped front face 114, relieved front face 116, and "A" inner face 118. Back faces include "A" outer raised back face 120, "A" channel bottom face 130, and "A" inner raised back face 132. "A" outer raised back face 120 is geometrically connected to channel bottom face 130 by "A" beveled entrance face 122 and "A" outer undercut face 124. "A" inner raised back face 132 is geometrically connected to channel bottom face 130 by "A" inner undercut face 126.

The undercut faces may amenably be formed at an angle of 15°. The obtuse angle where "A" beveled entrance face 122 and "A" outer undercut face 124 meet is therefore 150°. In general within the invention, faces may electively meet at a slight radius, in order to ease manufacturing, prevent splintering, or encourage smooth operation and safe handling.

Relieved front face 116 provides a setback from the canvas and also serves to conceal a flanged dovetail key. Dovetail key receiving recess 146 is shown formed in miter face 140. The dovetail key receiving recess allows for the insertion of a plastic, metal, or wooden key to form a structural connection between the four mitered wooden bars.

Alignment pin pilot hole 148 is formed in dimension "A" frame bar 100 so that alignment pin 510 may be reliably held within it. The hole may be cylindrical or conical in geometry, according to the desired compatibility with the inserted pin.

Dimension "A" frame spring kerf 134 runs from one mitered end of the bar to the other, and provides a proportionally deep and narrow rectilinear recess into the bottom of "A" channel bottom face 130.

The channel for the spline is formed to have the approximate width and depth of the body of the anticipated spline, which may be seen in FIGS. 7, 8, 9, 10, and 11. The spring kerf is formed so that the outer sidewall of each bar deflects slightly as the spline is inserted. The proportions of the deflecting sidewall may vary, for example, according to the wood species used, or according to particular bevel angles. A wall approximately 5 mm has been found effective within the invention given a softwood, such as douglas fir (*Pseudotsuga menziesii*), and 15° bevel angles.

In the 24 mm×36 mm frame stock described above, the integral deflective effect of the sidewall has been found to be effective when channel bottom face 130 is 9 mm below "A" outer raised back face 120 and "A" spring kerf 134 is 2 mm wide by 18 mm deep. The spline channel and the anticipated spline are therefore about one fourth the depth of the frame, while "A" spring kerf 132 extends through about one half the depth of the frame.

The assembled frame 10 may be understood in reference to FIGS. 2 and 3. Assembled frame 10 incorporates two dimension "A" frame bars 100 and two dimension "B" frame bars 200. Dimension "B" frame bar 200 dimension includes features in common with Dimension "A" frame bar 100, and would commonly be milled and cut to length from the same wood molding profile such that it effectively only differs in length from dimension "A" frame bar 100.

Correspondingly, in FIG. 2, dimension "B" frame bar front includes "B" front outer edge 202, dimension "B" frame part back outer edge 204, dimension "B" frame part back inner edge 206. Dimension "B" frame part 100 also includes corresponding surfaces. Faces seen in FIG. 2 include "B" outer face 212, "B" outer raised back face 220, "B" channel bottom face 230, and "B" inner raised back face 232. "B" outer raised back face 220 is geometrically connected to "B" channel bottom face 230 by beveled entrance face 222 and "B" outer undercut face 224. Inner raised back face "B" 232 is geometrically connected to "B" channel bottom face 230 by "B" inner undercut face 226.

Dimension "B" bars includes complex miters that are formed at each end of dimension "B" frame bar at a 45° angle, providing a stepped surface arrangement as in the dimension "A" frame bars. The manner in which dimension "A" frame bar miter face angled step 144 meets with "B" frame bar miter face angled step 244 may be seen in FIG. 2. As suggested previously, a combined 1.5 mm gap is within the functional range of the invention. FIGS. 7 and 8 show the location of flanged dovetail key 520, which is hidden from view in the view shown in FIG. 2.

FIG. 3 shows four mitered bars assembled into a frame and set out upon a piece of fabric. Fabric piece 300 may be preprinted with a design or image, or may be blank. The shape is defined by its perimeter, which includes fabric "A" side edges 302, two fabric "B" side edge 304, and four fabric diagonal corner edges 306. The hidden internal side of the fabric piece is defined as fabric back 312. The side of the fabric facing an anticipated viewer, which may carry imagery over the sides of the frame as well as on its face, is defined as fabric display face 314. (FIG. 4)

For a rectangular frame, the corner edges are established at 45° to the sides of the piece. The rectangle defined by the four midpoints of the diagonal edges should have a width and height that are substantially equal to the width and height of the frame plus the added dimension of the sides. For example, for a frame that is 500 mm×700 mm×36 mm deep, the fabric should have a dimension such that, if measured between the midpoints of the miters, a rectangular area of 536 mm×736 mm is defined. This arrangement allows a centered fabric piece to terminate at the four back corners, and thus permits a neat finish.

If the bars are 24 mm wide×36 mm deep in section, the allowance for wrapping the side and the back of the frame add up to 60 mm. An additional allowance of 20 mm permits a flap than can be drawn over alignment pins. Therefore fabric for a 500 mm×700 mm×36 mm deep frame, as described above, may be compatibly trimmed to a maximum outer dimension of 660×860 mm. This layout permits sufficient material to wrap around the back of the frame and be drawn into the spline slot during tensioning. The dashed lines indicate locations where folds occur during mounting of the fabric upon the frame. While these are represented as abstractions in the figure, these may electively be marked by visible printed graphics.

A printed graphic template upon fabric display face 314 may include indicia for alignment holes 310 so that an operator can accurately punch holes through the fabric after it is printed. In the present embodiment, a rigid backer ultimately covers the tab of fabric that includes the holes, so there is no cosmetic penalty to printing or perforating the region where the holes are located. Four pleats 320 occur at each corner and, while initially flat, take on various shapes through the mounting process.

The invention encompasses methods and devices for holding and assisting the assembly of the fabric over the frames. Folding jig 400 includes jig platform 410, jig footing 420, and jig table 430. Jig platform 410 provides a mounting surface for the entire jig assembly. Jig footing 420 raises jig table 430 so that the hinged jig fences 440 can move freely and so that attached fence extensions 460 can move underneath the edges of jig table 430.

Jig fences 440 are devised to employ concealed hinges 470 with an offset turning centerline. Such a centerline occurs in free space rather than about a physical component.

Within the invention, such hinges are used to allow supporting fences to be attached to a base, and then turned up against the side of a frame without intruding on the volume occupied by the frame. An amenable type of concealed hinge is manufactured by Soss (Pioneer, Ohio, USA). Hinges with an offset centerline may also be fabricated from interlocking extrusions of a rigid material such as aluminum.

Like the frames, the sides of the jig will typically be formed with two differing dimensions, dimension "A" and dimension "B", again differing only in length. The fences support the outside of the frame and accordingly will be longer in dimension than their associated bars, as may readily be envisioned.

Jig fence 440 jig include fence body 442, fence lip 444, side holding face 446, and fence back holding face 448. Jig fence extension 460 include extension relief angle 462 of about 45°. The relief profile may vary as long as the clearances fall within the relevant turning radii of the hinges, i.e., such that the fences can be raised and lowered through 90° without interference.

Magnets, such as round rare-earth magnets, are located in recesses in fence extension 460 and support block 490.

Referring now to FIG. 5, jig raised position miter faces 452 and jig lowered position miter faces 454 allow all four fences to be raised and lowered at independently without interference in any position. Concave pleat guides 456 are formed in the face of raised position miter faces 452 such that pleat 320 is shaped to conform to their surface geometry as the fences are raised.

The positioning and operation of magnets 480 may be understood by reference to FIGS. 4 and 6. Magnets 480, such as round rare earth magnets, are mounted in recesses so that their faces are nearly flush with the side of the fence extension. Corresponding magnets are similarly mounted in support blocks 490. The magnets may be secured with epoxy or other adhesive. The magnets are placed and oriented so that they meet with opposing magnetic polarity when the fences are in a raised position.

A complete operation of the present embodiment of the invention will now be described in reference to the figures. As described previously, a fabric piece, typically one with a printed image on its visible face, is cut to the prescribed octagonal outline and perforated at the illustrated locations. The four mitered frame bars are assembled using flanged dovetail keys 520 inserted into dovetail key receiving recess 146 to form assembled frame 10.

The fabric piece is set on a flat surface and the frame centered upon it as shown in FIG. 3. The fabric is then positioned on the frame using alignment pins 510, as shown in FIGS. 4, 5, and 6. The combined frame and fabric are placed on jig table 430. The fences begin in their lowered position and are moved into an upright position to flatten the fabric evenly and fold over the outer front edge of the frame. This operation intrinsically initiates a second fold over the back edge, as may be understood by reference to FIG. 6. The magnets retain the fences in an upright position, but may be released by the operator by simply overcoming their magnetic force, for example, by pushing outward on the fence, or on a knob or handle attached to it.

The friction of the fence retains the fabric with a limited degree of tension, until the fabric is free to be further tensioned by the insertion of the retaining splines. FIGS. 7 and 8 illustrate the insertion of the splines. A slight separation, where the fences meet at their mitered corners, allows a corner tool to gather the extra corner fabric and introduce the inverted folds at the corners into their receiving slots in the mitered frame. This method prevents bunching of the fabric at the corner folds, and forms a neat, finished and attractive corner joint. FIGS. 9, 10, and 11 illustrate the treatment of the fabric pleat at the corners of the frame. It may readily be envisioned that the fences may be kept in a raised position during these operations to promote flatness of the fabric.

FIG. 7 shows the position of spline 600 as it is located on the back side of frame bar 100, which has previously been integrated into assembled frame 10. Fin the depicted view, fabric has been applied to the frame. Rectangular rigid backer board 530 located on top of the fabric, and centered on the back of the frame. The backer board is dimensioned so that it just overlaps inner raised back faces 132 and 232 equally on each side of the frame, as may be envisioned by reference to the plan view in FIG. 3. The backer and the fabric surrounding the frame are both entrapped as the splines are pressed into place. The fabric is also drawn into tension.

Spline 600 includes spline retainer flange 602, spline inner sloped face 604, spline outer sloped retention face 606, and spline outer sloped holding face 608. The sloped faces are formed at 15° angles to conform to corresponding surfaces in the sides of the channel on the back of the frame bar. As with the shaping of the bars, spline edge radii may be used for safety, ease of manufacture, or to facilitate insertion and removal. External spline face provides a surface against which pressure may be applied, such as finger pressure, while internal spline face 630 is located to bear against the fabric overlying the channel.

Owing to the meeting of beveled entrance face 122 and the rounded corner between spline outer sloped retention face 606 and channel bottom face 630, each of which bears on the intermediate fabric piece 300, and owing to the relatively deep spring kerf 134, the outer wall momentarily deflects outward. Once the maximum deflection has been achieved, the cooperative effect of the parts draws the spline into the channel, where it is retained as in FIG. 7.

This process directly tensions the fabric along the length of each side. It provides a strong retaining force, in part due to the amount of surface area shared by the channel, the spline, and the intervening fabric, yet the necessary insertion force is no greater than normal finger pressure. The insertion process may be reversed as required by the insertion of a flat bladed tool, such as a paint scraper, screwdriver, or putty knife, against spline outer sloped holding face 608 and lifting.

The insertion of the splines leaves corner pleat 320 outside the frame but gathered into a bilobate shape, as shown in FIG. 9. The pleat can be worked into the joint with a thin bladed tool. However, speed and accuracy can be improved by using a dedicated, prealigned implement.

Corner tool 800 is devised to guide a thin metal too so that it pushes the extra fabric at the corners into the previously devised recesses at the corners of the frames. Corner tool 800 may be made of spring steel having a thickness of 0.25 to 0.75 mm. Corner tool retainer 810 provides a mounting and center of rotation for the blade of the tool. Corner tool 800 has tool blade 802, tool reflexed shank 804, tool mounting hole 806, and corrugated teeth 808. The tool is mounted to the underside of jig table 430.

This configuration guides the tool along particular angular path, such that the tool meets on the inner slope of the miter face against the internally joined angled steps 144 and 244. The tool meets these steps at shallow, oblique angles and presses the fabric into the wood surfaces. Corrugated teeth 808 are devised to be blunt so that the tool is prevented from piercing or catching on the fabric.

Blade 802 is proportioned so that the back of the blade remains outside the frame when the blade is fully engaged in the corner of the frame. In this way, the fabric cannot gather behind the blade and be inadvertently withdrawn as the blade is disengaged. The tool may be coated with a secondary material, such as Teflon, to reduce undesirable frictional effects, or to prevent discoloration of the fabric.

It may be seen by general reference to the figures that the tool engages with the preformed bilobate shape of the pleat such that the pleat is evenly divided by the tool. The result after the tool is withdrawn is shown in FIG. 11. An effectively permanent internal fold is made at each corner that takes up and hides the extra material left at each corner of the frame, while providing tension both across the frame and at the corners.

It may be understood that the fence system may be structurally integrated into an assembly jig with the previously mentioned bilobate fabric and with a plurality of the bladed corner tools. For example, jigs may be made with fences at each side and tools at each corner for the rapid and reliable amounting upon frames of a fixed dimension.

Alternately, the fence system may take various forms depending on expected variations in the size of the frame, and other factors such as the availability of workspace.

The fence system may accordingly be a single bar, a fixed "L" shape, a box, or an arrangement of fences that can be tilted or laid flat to engage and disengage a workpiece. Useful variations of the invention include other hinging means in which the hinge itself is expressly devised so that it no part of the hinge structure intrudes into the regions where the fabric is folded about the frame.

An example of an alternative to mechanical concealed hinges is shown in FIG. 12. The invention encompasses methods and devices for holding and assisting the assembly of the fabric over the frames. Fabric-lined folding jig 1000 includes fabric-lined jig platform 1010, fabric-lined jig footing 1020, and fabric-lined jig table 1030. Fabric-lined hinged jig fences 1040 are attached to fence extensions 1060 so that they can move underneath the edges of jig table 1030.

Fabric-lined jig fences 1040 are devised to turn about the fold lines of durable fabric that has been bonded to the adjoining solid parts. Adhered fabric facing 1090 is bonded to the surface of fabric-lined jig table 1030 and fabric-lined hinged jig fences 1040. Woven linen is laminated to the fence and table such that the fences turn about hinge lines 1092. Such hinges may be used as an alternative to mechanical hinges, and can also be turned up against the side of a frame without meaningfully intruding on the volume occupied by the frame.

Fabric-lined jig fence 1040 jig include fence body 1042, fence lip 1044, side holding face 1046, and fence back holding face 1048. Jig fence extension 1060 include extension relief angle 1062 of about 45°. The relief profile may vary as long as the clearances fall within the relevant turning radii of the hinges, i.e., such that the fences can be raised and lowered through 90° without interference. Fabric-lined fence extension 1060 and fabric-lined fence support block 1070 house magnets 1080, such as round rare-earth magnets, are located in commensurate recesses.

FIG. 13 shows a second alternate jig design formed according to the invention in which the fence is fixed to a platen. Fixed fence jig 1100 includes a fixed fence base 1110 and fixed fence 1120 that are fixedly attached, for example, by hardware or adhesive. Fixed fence face 1122 and fixed fence lip 1124 are dimensioned so that a commensurate frame may be momentarily pressed against the fence during the insertion of the splines. A fixed fence may be made of indeterminate length. A single length or two lengths at right angles may be used, for example, when frame dimensions are large or irregular.

FIG. 14 shows a further variation of a holding jig, particularly for frames of predetermined dimension. FIG. 14 depicts a jig design in which the fences are fixed to a platen, and in which the fences have facings of resilient material. The fences are arranged as a box into which the frame is inserted. As the frame is temporarily installed in the box, resilient material pre-tensions the fabric against the frame.

Box jig 1200 includes box jig base 1210, box jig fence 1220, and box jig resilient facing 1230. Examples of resilient facing include foam or felt of about 6 mm in thickness. In the operation of this modification, the fabric is loosely attached over pins 510. The assembly of the frame and fabric is then lowered into the volume defined by the fences, compressing the resilient facing, which in turn flattens the fabric piece against the sides of the frame. The splines may then be inserted to tension the fabric piece.

FIG. 15 describes an alternate template for the layout of the fabric piece. In this variation, the corners of the fabric piece are provided with corner extensions in the form of contiguous tabs than can serve as tensioning implements.

FIG. 15 shows four mitered bars assembled into a frame and set out upon a piece of fabric. Tabbed fabric piece 1300 may be preprinted with a design or image, or may be blank. The shape is defined by its perimeter, which includes tabbed fabric "A" side edges 1302, two tabbed fabric "B" side edge 1304, and four tabbed fabric diagonal corner edges 1306. The hidden internal side of the fabric piece is defined as tabbed fabric back 1312.

The side of the fabric facing an anticipated viewer, which may carry imagery over the sides of the frame as well as on its face, is defined as tabbed fabric display face 1314.

Tabbed fabric display face 1314 may include indicia for tabbed fabric alignment holes 1310. Four tabbed fabric pleats 1320 occur at each corner and include extended tabbed areas 1322 of fabric that can be used to manipulate and tighten the fold of extra material within a miter joint formed according to the invention.

FIG. 16 is a sectional view of a miter employing the tensioning tabs illustrated in FIG. 15. It may be understood from the drawing that extended tabbed area 1322 is folded in two in the process of inserting tabbed fabric pleat 1320 into the partial gap in the miter. The tab is pulled parallel to miter face angled steps 144 and 244. The tab can be wedges in place between the wood bars. In this case, the corners may be tightened before the splines are inserted to allow the tab to be deflected out of view by the splines.

FIG. 17 describes a further template for the layout of the fabric piece, in which the corners are provided with elongate holes than work compatibly with a separate tensioning implement, such as a hooked tool.

As in previous variations, four mitered bars assembled into a frame and set out upon a piece of fabric. Hook-tensioned fabric piece 1400 may be preprinted with a design or image, or may be blank. The shape is defined by its perimeter, which includes hook-tensioned fabric "A" side edges 1402, two hook-tensioned fabric "B" side edge 1304, and four hook-tensioned fabric diagonal corner edges 1406. The hidden internal side of the fabric piece is defined as hook-tensioned fabric back 1412. The side of the fabric facing an anticipated viewer, which may carry imagery over the sides of the frame as well as on its face, is defined as hook-tensioned fabric display face 1414.

Hook-tensioned fabric display face 1414 may include indicia for tabbed fabric alignment holes 1410. In this variation the alignment holes are elongate such that corner holes can be made with the same perforating tool. Elongate corner holes 1422 are formed at each corner. The holes may be usefully made to a size of 2 mm by 6 mm. Four hook-tensioned fabric pleats 1420 occur at each corner and include elongate corner holes 1422 of fabric that can be used in combination with a compact tool to manipulate and tighten the fold of extra material within a miter joint formed according to the invention. Headed pins 550 in frame 10 in combination with elongate corner holes 1422 in hook-tensioned fabric piece 1400 allow a small degree of fabric movement during tensioning.

FIG. 18 is a sectional view of a miter employing the tensioning implement inserted through an elongate hole in the fabric piece shown in FIG. 17. Hooked tool 900 is laced through elongate corner hole 1422 and used to pull the pleat into the miter. Hooked tool 900 can take many forms, but is exemplified here by hook 902, hook shaft 908, and hook grip 906. The hook may be devised to be removed or to be left sacrificially within the frame enclosure.

The holes, whether round, elongate, or otherwise shaped, may also be usefully employed to align the frame with the canvas via an intermediate stricture such as the folding jig shown in FIGS. 4 through 6 inclusive. For example, a folding jig may be provided in a state in which the fences are partially raised to form a hopper-like shape about the central platform. A suitable angle for such a configuration is 45°.

Any plurality of suitably-positioned locator pins mounted on the jig will intrinsically fix the location of the fabric relative to the jig whenever a plurality of commensurate holes are disposed over a plurality of pins. Pins may be located at otherwise vacant areas at the corner regions of the jig, and may conveniently be seated on angled ramps at conform to the temporary seating of the fabric within the jig.

In such an exemplary case, there will typically be four holes provided in the fabric and four corresponding pins.

In this scenario, the fabric is first securely aligned with the jig by mounting the fabric upon the pins. The frame is then seated in mechanical reference to the jig. When a compatibly sized frame is set onto the platform and seated between the partially-raised fences, the angled sides prohibit the displacement of the frame and establish it in a known location. The jig, fabric, and frame are in mutual registration. The sides of the jig may then be raised to fold the fabric about the frame and hold it in place as the splines are inserted.

The mechanisms by which the fences may be raised and retained are various. For example, the fences may be raised by electrical, pneumatic, or hydraulic assistance. The fences may be raised and fixed in place manually by any variety of catches, springs, magnets, electromagnets, solenoids, linkages, four-bar mechanisms, swing-arms, moveable buttresses, or other amenable devices or structures.

The fence system may integrate a variety of functions and be made of a range of materials. For example, a fence made of metal such as extruded aluminum may include integral centerless hinge components. It may also include grooves or tracks into which a compatible tool may be inserted and employed as a lever. By this means, mechanical advantage may be obtained, and an increase in the insertion force applied between a spline and a rail component may be improved.

Such a tool may be readily be devised so that it can be inserted, utilized, and then removed to a new location about the frame. The tool and fence may remain at a fixed relative location, may be slidably engaged, or may be fully separable. The location and degree of applied force may be modulated by the shape and bearing surface of the tool. The tool or jig components can be provided with stops, guides, rules, gauges, or instructions to facilitate and expedite use and optimize results.

By these means, a substantial force may be applied progressively about the perimeter of the frame. This additional leverage can be used to impart an electable degree of tension between a piece of fabric and its associated frame. The supplemental leverage provided by the tool in this instance will typically increase the tension and the permanence of the fabric's mounting.

In previously described versions of the invention, the meeting of miter faces formed at the ends of the wooden rails creates a gap of predetermined width and depth. However, a gap with a width and depth of high consistency may be created by forming a discrete component in which the gap at the miter angle is already formed. More specifically, an injection-molded part may be formed in the general shape of a rectangular block.

In this embodiment of the invention, the piece includes an angled slot at the miter angle. Two adjoining faces of each block-shaped piece meet two wooden rails which have been cut square. Four molded corner pieces and four rails are assembled to make one rectangular frame. Square ends are generally leave less waste and are generally more economical than mitered ends.

Further understandings of this implementation may be understood by reference to the relevant figures.

The injection-molded corner pieces can be made partially hollow using methods well known to those practiced in the art. The molded part can include a range of multifunctional features.

The wooden rails are devised to have corresponding dowel holes drilled in each end matching the location of the integral dowel ends. The corner pieces are designed and dimensioned so that when the dowel ends are inserted into the dowel holes, a joint is made having a friction or interference fit such that the frame remains assembled during handling.

Furthermore, each corner block is formed such that the two external faces of the corner piece become substantially flush with the external faces of the rails when the rails are joined to the corner piece. In this manner, the canvas can be wrapped about the frame without the joints between the rails and the corner pieces being visible through the tensioned canvas.

FIG. 19 shows a schematic sectional view of an alternative set of spline and rail profiles suitable for use within the invention. The spline has two distinct ridges which engage with corresponding troughs on a complementary rail. Dual-ridge rail section 1510 includes two dual-ridge rail end faces 1512. Each dual-ridge rail end face is interrupted by two blind holes 1514. The blind holes are drilled to at locations and to depths so that the integrally molded dowel ends may be received within them. Namely, the holes are drilled to a depth equal to or slightly greater than the extension of those cylindrical features, and at locations such that at each joint two dowels extensions may be disposed concentrically within the two corresponding holes. A general understanding of the joinery of prefabricated corner pieces to a frame may be made by anticipatory reference to the exploded assembly view shown in FIG. 34.

Attributes of dual-ridge rail 1510 include dual-ridge rail outer face 1516 and dual-ridge rail inner face 1518. Outer backer-board rabbet 1520 is formed along the back inside edge of the rail. Dual-ridge rail inner channel 1522 and dual-ridge rail outer channel 1524 are formed in the back of the rail. Dual-ridge rail retainer recess 1526 is formed in the shape of a concave recess along the length of the rail section.

The front of the rail section includes dual-ridge rail recessed surface 1528, and dual-ridge rail raised canvas bead 1530.

Dual-ridge spline 1550 includes dual-ridge rail backer board retainer face 1552, dual-ridge rail inner ridge 1554, and dual-ridge rail outer ridge 1556. Tool slot 1558 provides a narrow channel into which a bladed tool may be fitted to lift and remove the spline without damage. Dual-ridge spline includes convex bead 1562 which engages with dual-ridge rail retainer recess 1526, and traps dual-ridge fabric 1580.

The fitting of the canvas to the frame may be appreciated by the position of dual-ridge fabric 1580 between the rail and spline. It has been discovered that the fabric naturally tents across retainer recess 1526 in a manner such the engagement of the spline with the rail results in an exceptional degree of tension being introduced to the main exposed face of the fabric.

Doweled corner piece 1610, illustrated in FIGS. 20, 21, 22, and 25, includes diverse functional features. FIG. 20 is an end view of a molded corner piece. FIG. 21 is an oblique back view of the part shown in FIG. 20. FIG. 22 is an oblique front view of the same part. FIG. 25 is a partially exploded perspective view of a corner subassembly, showing the functional relationship of the corner piece, a compatibly designed corner cap, and a bumper.

The corner piece includes corner piece external face 1612. The external face is here made flat so as to be made contiguous and coplanar with dual-ridge rail outer face 1516 when the corner piece and the rail are engaged. Analogously, corner bead 1614 aligns with dual-ridge rail raised canvas bead 1530, and corner piece recessed face 1616 aligns with dual-ridge rail recessed surface 1528. Radiused back edge 1618 provides geometrical continuity with dual-ridge rail raised canvas bead 1530.

A pair of molded dowel ends 1622 extends from each of the two faces that are to be joined with the wooden rails. Each dowels has a hollow core and is chamfered to ease insertion. The integrally formed dowels are braced by integral fins 1624. Corner piece inner partition 1632 includes snap feature 1634. Corner cap guide 1636 is formed in the shape of a cylindrical quadrant arc. The angled miter slot is defined by sidewalls 1642.

The interfitting relationship between corner piece 1610 and corner cap 1710 may be appreciated by reference to FIG. 25. The entry and exit angles of snap feature 1634 may be electively varied according to the material and the desired insertion and extraction force, as is well understood in the practice of the art of thermoplastic component design.

FIGS. 23 and 24 illustrate corner cap 1710. FIG. 23 is a perspective view of the external side of corner cap for use with the corner piece shown in FIGS. 20 through 22 inclusive. FIG. 24 is a perspective view of the internal side of corner cap for use with the same corner piece design. FIG. 25 shows a corner piece, a corner cap, and a bumper in a separated condition.

Corner cap 1710 includes flat corner cap surface 1712 in which corner cap hole 1714 is formed. Corner cap guide fin 1716 is formed of two walls making a right angle. Corner cap fastener extension 1718 includes cap snap fitting 1722. Cap snap fitting 1722 has angled entrance and exit faces, which may be variably designed to ease or resist insertion or removal.

In FIG. 25 illustrates the relationship of corner piece 1610, corner cap 1710, and bumper 1810. Once the frame is assembled, and canvas tensioned by the insertion of the splines, corner caps 1710 are installed to trap the tensioned canvas at the corners and to provide a finished appearance. Snap features 1634 and 1722 engage and hold the parts in a secure but eversible subassembly. Bumper 1810 serves as a cushion, and provides an even spacing of the assembled frame from the wall or other mounting surface, and may be molded, for example, of rubber or thermoplastic elastomer. The bumper includes a distinct bumper shaft 1812 and bumper cap 1814.

The use of corner cap hole 1714 is not limited to receiving bumper 1810. Indeed, the hole is designed to be compatible with fasteners so that the canvas-covered frame may be attached to a secondary frame, such as those know in the art as shadowbox frames. These frames are available both in wood and polymer versions. The polymer used in a secondary frame need not be solid, but may be a hollow extrusion or an expanded polymer foam.

FIG. 26 shows a front view of square corner block frame 1500 assembled from four rails and four prefabricated corner pieces. FIG. 27 shows a rear view of the same frame. While the rectangular corner block frame depicted in FIG. 34 is of a slightly different design, the relationships of the parts prior to the assembly of the frame is similar to what it would be in the case of the square frame shown in FIGS. 26 and 27.

Referring back to FIG. 19 and FIGS. 20 through 22, it may be understood that arch air of molded dowel ends 1622 in each case may be fitted into a corresponding pair of blind holes 1514, and that the joining of four rail sections and four corner pieces results in a frame exemplified by square corner block frame 1500. Because of the geometrical continuity of the front surfaces of the corner pieces and their compatibly formed rails, the canvas may be tensioned across a square or rectangular opening while only supported by the raised features characterized by rail raised canvas beads 1530 and corner beads 1614.

An advantage of the spine and rail set used in conjunction with the components illustrated in FIGS. 19 through 27 inclusive is that the a molder can create the effect of an undercut without resort to a universal head. A molder in this case is a machine with a plural of rotary spindles fitted with cutters that progressively shape a piece of wooden stock into a molding of a predetermined profile.

A universal head is provided on some molders, usually in combination with multiple conventional cutters. The shaft of a universal head differs from conventional spindle heads in that may be tilted to allow for specialty cutting, as for undercut features such a dovetails. However, this equipment is less readily available than conventional molders, and set-up of a universal head can be relatively time-consuming and costly. In such circumstances, the election of a design that forgoes the use of a universal cutter can provide significant efficiencies and economies.

In dual-ridge rail 1510, rail retainer recess 1526 can be formed by a cutter introduced from the inside of the anticipated rail, rather than from the anticipated back side. Dual-ridge spline includes convex bead 1562 thereby engages with dual-ridge rail retainer recess 1526 like a snap fitting or other undercut faster, without the complication of actual undercutting.

FIG. 28 shows a schematic sectional view of a further set of spline and rail profiles suitable for use within the invention, in which the spline has a single prominent ridge which engages with a corresponding trough on a complementary rail. Many of the features nevertheless are analogous to those in the spline rail set and FIG. 19. However, in this instance, the clamping force is provided by a cooperating pair of compressible raised beads, rather than by the bead and grove combination shown in FIG. 19.

Referring now to FIG. 28, single ridge rail 2010 include single ridge rail end face in which two single ridge rail dowel holes 2014 have been drilled. Single ridge rail outer face 2016 and single ridge rail inner face 2018 respectively define the outer and inner surfaces of the rail profile. Single ridge rail backer-board rabbet 2020 allows a backer panel to be retained securely between the spline and rail. Single ridge rail channel 2022 is formed as a trough in the back side of the frame. Single ridge rail bevel 2024 removes wood such that the surface length of the profile over which the canvas is lapped is reduced, which in turn can increase the hold of the spline and rail combination upon the entrapped canvas.

Single ridge rail recessed surface 2028 keeps the canvas away from the majority of the rail width, while single ridge rail raised canvas bead 2030 elevates the canvas along the perimeter of the frame.

Single ridge spline 2110 includes single ridge spline lower canvas retention bead 2014 and single ridge spline upper canvas retention bead 2016. Single ridge spline tool 2118 provides a narrow channel into which a bladed tool may be fitted to lift and remove a spline which has been reversibly installed in the rail. Single ridge external face 2122 provides a flat surface upon which pressure may be brought to bear during installation of the canvas upon the frame. Backer board retainer face 2124, when fitted over single ridge rail backer-board rabbet 2020, provides an enclosed channel that secures the backer board in place. During installation, single ridge spline lower canvas retention bead 2014 and single ridge spline upper canvas retention bead 2016 progressively tension traps single ridge fabric 2300.

Single-ridge rail molded corner piece 2210, illustrated in FIGS. 29, 30, 31, includes additional functional features, and is compatible with the spline and rail profiles illustrated in FIG. 28. FIG. 29 shows an oblique rear perspective view of a single-ridge rail molded corner piece 2210 Features exhibited in this embodiment include integral ribbed dowels, FIG. 30 shows an inner perspective view of single-ridge rail molded corner piece 2210, and FIG. 31 shows a back view of a molded corner piece single-ridge rail molded corner piece 2210, showing a slot formed at the miter angle, Single-ridge rail molded corner piece 2210 includes single-ridge rail molded outer face 2212. The external face is here made flat so as to be made contiguous and coplanar with single ridge rail outer face 2016 when the corner piece and the rail are engaged. Analogously, single-ridge rail raised canvas bead 2210 aligns with single-ridge corner raised canvas bead 2214, and single-ridge corner piece recessed face 2216 aligns with single-ridge corner rail recessed surface 2028.

A pair of single-ridge corner molded dowel ends 2222 extends from each of the two faces that are to be joined with the wooden rails. Each dowel has a hollow core and is chamfered to ease insertion. The dowels in this embodiment include a plurality of longitudinal ribs 2224. Such ribs are sometimes called crush ribs, and enable secure assembly of the frame, with our without adhesive. Irrespective of the name employed, the holding action my result from the intrusion of the ribs into the wood grain as much as from the compression of the ribs themselves. The integrally-formed ribbed dowels are braced by single-ridge corner integral fins 2226. Single-ridge corner piece partition 2232 includes single-ridge corner snap features 2234.

The configuration of the miter slot may be seen in particular reference to FIGS. 30 and 31. Single-ridge corner miter slot wall 2242 includes fabric retention ribs 2244 on either side of the slot formed by the facing sidewalls. The fabric retention ribs locally narrow the slot, so that once a fold of fabric is introduced into the slot, it will resist withdrawal. The retention ribs may be beaded, cuspated, or barbed to encourage fabric retention.

FIG. 32 shows a length of the spline material shown in the spline and rail combination illustrated in FIG. 28. FIG. 33 shows a length of the rail material included in FIG. 28. The geometrical relationship of exemplary lengths of single ridge rail 2010 and single ridge spline 2110 may be appreciated by concurrent reference to the drawings.

FIG. 34 is an exploded drawing showing the main components of the frame system of the preceding figures, absent the fabric piece. The illustration provides an overview of relevant components of the invention. In the drawing, two single ridge rails 2010 are arranged oppositely, while two longer single ridge rails 2050 take the other two positions in a rectangular arrangement. Four single-ridge rail molded corner pieces 2210 are set at the corner positions. The integral ribbed dowels are aligned with their corresponding holes in the ends of the rail parts. These eight components can then be securely assembled into a frame by the application of a joining force between the components. The joining force may be applied by hand, by a tool such as a soft mallet, or by various actuation or automation scenarios.

Backer panel 2500 is then set into the rabbets on the inner edges of the four rails. Sawtooth hanger 2600 may be made of metal, and is formed so that it may partially engaged with a rail. At this stage, a compatibly prepared fabric piece (not shown) would typically be wrapped about the assembled frame using an expressly fabricated hinged fence system. The four splines, here including single ridge spline 2110 and longer single ridge spline 2150, are then installed, as in the sectional drawing shown in FIG. 28. The insertion of the splines tensions the canvas, and entraps the backer panel and the hanger between a rail and its corresponding spline.

Four single ridge corner caps 2310 are pressed into place, analogously to the components shown in the earlier embodiment shown in FIG. 25. Four single ridge corner bumpers 2410 complete the assembly of the exemplary frame. If adjustments are necessary, a wide bladed tool may be located in the tool slot in the splines, and each spline lifted from its engaged relationship.

Diverse variations are foreseen within this variation of the invention. For example, the dowels may be devised to be square, D-shaped, or half-round, and compatible grooves formed in the bars during the shaping of the molding. In this case, while the retaining grooves may extend the length of the bar, the integral dowels only need extend into the channels to a depth sufficient to adequately grip or place the bar. One such groove may be integrally formed with the feature exemplified by spring kerf 134, and may advantageously limit inward deflection of the somewhat pliant outer wall of the bar. For example, FIG. 35 is a cross-sectional view showing a bar 101 similar to the ones described herein. The bar 101 includes one or more grooves 103 formed therein. In the illustrated embodiment, there are three groves 103. Integral pins 105 that extend from the plastic corner block are gripped by the grooves 103 formed in the bar 101. It will be appreciated that the size and shape of the grooves 103 and pins 105 can vary. In the present invention, each groove 103 has a square shape with parallel side walls and the pin 105 is square shaped.

As noted earlier, folding jigs may be variously devised in accordance with the invention, and may include wooden, plastic, and metal components or subassemblies. Parts of the jigs or frames may be molded, extruded, sintered, milled, or machined, or additively amassed using solid printing techniques, without departing from the spirit and intended reach of the invention. Tensioning tools mat be devised to be momentarily or permanently attached to a folding jig or its fences, and may be adapted to specific component sizes or profiles.

The structures and procedures described in the figures and specification have been found to provide and retain a high degree of tension in a canvas material that is installed according to the teachings of the invention. Furthermore, the assembly is relatively straightforward, and the system may be provided in kit form such that no element requires the application of liquid or film adhesive. This generally increases the rate at which the canvas may be mounted on the frame, and reduces the skill level necessary to achieve success in the mounting of a plain or pre-printed canvas.

It may therefore be appreciated from the foregoing discussions that the frame system of the invention may be implemented in a great diversity of applied designs, of which the recited examples are only emblematic.

The invention can therefore take diverse forms and should be taken to be limited only by the reach all of its prospective features (points), including but not limited to:

a. A frame for receiving a fabric material, said frame including a plurality of bars, in which each bar has two mitered ends, and in which each of said mitered ends includes two discrete mitered faces occupying different geometrical planes.

b. A frame for receiving a fabric material, said frame including a plurality of bars, in which each bar has two mitered ends, and furthermore in which said bars have a channel formed in one side, in which said bars are devised such that the outer wall of each bar can deflect upon the insertion of a second part into said channel.

c. A frame for receiving a fabric material, said frame including a plurality of bars, in which each bar has two mitered ends, and furthermore in which said bars have a channel formed in one side, in which said channel includes an undercut angle.

d. A bar employed in forming an anticipated frame for receiving a fabric material, said anticipated frame including a plurality of bars, in which said bar has two mitered ends, in which said bar includes a pin raised above one face of the bar, such that a piece of perforated fabric may be entrained about said pin.

e. A frame kit for receiving a fabric material, said frame kit including a set of bars, in which each bar has two mitered ends, and furthermore in which at least two bars include pins in one side.

f. A frame kit for use in a frame designed to receiving a fabric material, said frame kit including a plurality of bars, in which each bar has two mitered ends, and in which each of said mitered ends includes two discrete mitered faces occupying different geometrical planes.

g. A mitered frame covered in a fabric, said mitered frame comprising a plurality of bars, said mitered frame each having two mitered ends, said mitered frame having a plurality of mitered corners formed by the joining of two mitered ends, in which a pleat of fabric is retained between said mitered corners, and in which a part of the faces of mitered ends is raised relative to the location of said pleat within said miter such that said two mitered ends are in direct contact at said mitered corner.

h. A piece of fabric material for mounting upon a frame, said piece of fabric material including at least two openings at two opposite ends, such that said piece of fabric material may be entrained about two compatible relief features to establish a positional relationship with said frame.

i. A piece of fabric material for mounting upon a frame, said piece of fabric material including a plurality of tabs, said tabs disposed such that a pleat of said piece of fabric material may be manipulated into a folded state and said piece of fabric material drawn into a state of tension in the vicinity of each tab location.

j. A piece of fabric material for mounting upon an anticipated frame, said piece of fabric material including at least one opening in a diagonal relation to said anticipated frame, such that part of a tool may be engaged in said openings, and such that said tool may locally impart tension to said piece of fabric.

k. A jig for holding a piece of fabric against a frame, including a plurality of hinged fences, said hinged fences being hinged such that they turn through an angle sufficient to trap fabric against a frame.

l. A jig for holding a piece of fabric against a frame, including a plurality of hinged fences, said hinged fences being hinged by hinges having an offset center of rotation.

m. A jig for holding a piece of fabric against a frame, including a plurality of hinged fences, said hinged fences being hinged by a fabric applied to said hinged fences.

n. A jig for holding a piece of fabric against a frame, including a plurality of padded fences, in which said padded fences are faced with resilient material.

o. A jig for holding a piece of fabric against a frame, including a fixed fence, in which said fixed fence includes a lip under which a frame covered with said piece of fabric may be inserted.

p. A tool for inverting a pleat of fabric at the corner of a frame, in which the tool comprises a blade attached to a table, said tool being disposed such that the corner of a frame which has been wrapped in fabric may be aligned with said tool, said tool operating in a diagonal relationship to said frame, such that said tool evenly divides said pleat upon movement of said tool toward said frame.

What is claimed is:

1. A frame for maintaining a region of a fabric piece in a substantially planar state, comprising:

a plurality of rails, each of said rails having a geometrical profile extended in a linear direction, said rails each having a first face and a second face, each rail having at least one open channel formed longitudinally along and being open along the first face, and a plurality of corner pieces, each of said corner pieces including a slot formed partially through said corner piece at a miter angle, each corner piece including at least one pin that extends outwardly from each of a first end face and a second end face of the respective corner piece, the at least one pin being configured to received and grippingly held within the at least one open channel of a respective rail, wherein the first face comprises an inner face that faces and defines a center opening of the frame.

2. The frame of claim 1, wherein the number of rails is equal to the number of corner pieces.

3. The frame of claim 1, wherein the rails are made of wood.

4. The frame of claim 1, wherein the corner pieces are formed of a polymer composition.

5. The frame of claim 1, in which said slot formed partially through said corner piece at a miter angle is sufficiently deep to receive a pleat of surplus fabric formed when two areas of said fabric piece are turned along a seams at right angles to one another into an upright condition departing from the primary plane establishing the planar state of said fabric piece.

6. The frame of claim 5, in which said upright condition locates said two areas of said fabric in planes perpendicular to said primary plane establishing said planar state of said fabric piece.

7. The frame of claim 1, wherein the plurality of corner pieces exclusively define all corners of the frame and are separate parts relative to the plurality of rails, each slot being defined and formed only in a respective corner piece and not in the plurality of rails.

8. A frame for maintaining a region of a fabric piece in a substantially planar state, comprising:

a plurality of rails, each of said rails having a geometrical profile extended in a linear direction, said rails each having a first face and a second face, each rail having at least one open channel formed longitudinally along and being open along one of the first face and the second face;

a plurality of corner pieces, each of said corner pieces including a slot formed partially through said corner piece at a miter angle, each corner piece including at least one pin that extends outwardly from each of a first end face and a second end face of the respective corner piece, the at least one pin being configured to received and grippingly held within the at least one open channel of a respective rail; and a plurality of splines, each spline and each rail including interfitting features such that upon insertion of each spline into one respective rail, the fabric piece is entrapped between a raised elongated protrusion and a corresponding elongate recess.

9. The frame of claim 8, wherein the elongated recess is formed along the first face of the rail and one face of the spline includes the raised elongated protrusion.

10. A frame for maintaining a region of a fabric piece in a substantially planar state, comprising:

a plurality of rails, each of said rails having a geometrical profile extended in a linear direction, said rails each having a first face and a second face, each rail having at least one open channel formed longitudinally along and being open along one of the first face and the second face; and a plurality of corner pieces, each of said corner pieces including a slot formed partially through said corner piece at a miter angle, each corner piece including at least one pin that extends outwardly from each of a first end face and a second end face of the respective corner piece, the at least one pin being configured to received and grippingly held within the at least one open channel of a respective rail;

wherein the first face and second face of the rail are substantially perpendicular to one another and each of the first face and the second face includes at least one open channel and each of the first end face and the second end face includes at least one pin.

11. The frame of claim 10, wherein the first face of the rail comprises an inner face and the second face comprises a top face, the first face having a plurality of open channels formed and open therealong, the second face having one open channel, each of the first end face and the second end face having three pins.

12. The frame of claim 11, wherein the one open channel and a topmost open channel formed along the first face lie in a common horizontal plane that intersects the first face at a 90 degree angle.

13. A frame for maintaining a region of a fabric piece in a substantially planar state, comprising:

a base defining a major plane having four sides;

each side of the base having a first face and a second face, each side of the base having at least one open channel formed longitudinally along and being open along the first face;

a plurality of corner pieces, each of said corner pieces including a slot formed partially through said corner piece at a miter angle, each corner piece including at least one pin that extends outwardly from each of a first end face and a second end face of the respective corner piece, the at least one pin being configured to received and grippingly held within the at least one open channel of a respective side of the base; and a plurality of splines, each spline and each rail including interfitting features such that upon insertion of each spline into one respective rail, the fabric piece is entrapped between a raised elongated protrusion and a corresponding elongate recess that is located along the second face.

14. The frame of claim 13, wherein the slot formed partially through the corner piece at a miter angle is sufficiently deep to receive a pleat of surplus fabric formed when two areas of the fabric piece are turned along seams at right angles to one another into an upright condition departing from a primary plane establishing the planar state of the fabric piece.

15. The frame of claim 1, wherein a second face of each rail has an open channel formed therein and the at least one pin of each corner piece includes a pin that is received within the open channel of the second face, wherein the second face comprises a rear face that further includes an interfitting feature for entrapping the fabric piece along the second face.

16. A frame comprising:

a plurality of rails, each of said rails having a geometrical profile extended in a linear direction, said rails each having a first face, each rail having at least one open channel formed longitudinally along and being open along the first face, a plurality of corner pieces, each of said corner pieces including a slot formed partially through said corner piece at a miter angle, each corner piece including at least one pin that extends outwardly from each of a first end face and a second end face of the respective corner piece, the at least one pin being configured to received and grippingly held within the at least one open channel of a respective rail; and a fabric piece that has a region that is maintained in a substantially planar state across the frame, wherein the fabric piece is disposed across the first face of the rail and covers the at least one open channel.

* * * * *